US010458756B2

(12) United States Patent
Whitaker

(10) Patent No.: US 10,458,756 B2
(45) Date of Patent: Oct. 29, 2019

(54) FLEXIBLE ADHESIVE BALLISTIC SHIELD

(71) Applicant: Scott R. Whitaker, Hamilton, OH (US)

(72) Inventor: Scott R. Whitaker, Hamilton, OH (US)

( * ) Notice: Subject to any disclaimer, the term of this patent is extended or adjusted under 35 U.S.C. 154(b) by 346 days.

(21) Appl. No.: 14/857,372

(22) Filed: Sep. 17, 2015

(65) Prior Publication Data

US 2016/0054100 A1 Feb. 25, 2016
US 2017/0030687 A9 Feb. 2, 2017

Related U.S. Application Data

(63) Continuation-in-part of application No. 14/212,070, filed on Mar. 14, 2014.

(60) Provisional application No. 61/788,459, filed on Mar. 15, 2013.

(51) Int. Cl.
*F41H 5/04* (2006.01)
*F41H 5/013* (2006.01)
*F41H 5/24* (2006.01)

(52) U.S. Cl.
CPC ..... *F41H 5/0485* (2013.01); *F41H 5/013* (2013.01); *F41H 5/0478* (2013.01); *F41H 5/24* (2013.01)

(58) Field of Classification Search
CPC ..... F41H 5/013; F41H 5/0478; F41H 5/24; F41H 5/0485
See application file for complete search history.

(56) References Cited

U.S. PATENT DOCUMENTS

| | | | | |
|---|---|---|---|---|
| 4,822,655 | A | 4/1989 | Foster | |
| 5,095,068 | A | 3/1992 | Chiu | |
| 5,124,195 | A | 6/1992 | Harpell et al. | |
| 5,531,500 | A | 7/1996 | Podvin | |
| 5,690,526 | A | 11/1997 | Lin et al. | |
| 5,789,327 | A | 8/1998 | Rousseau | |
| 6,074,722 | A | 6/2000 | Cuccias | |
| 7,186,442 | B2 | 3/2007 | Myers et al. | |
| 7,637,073 | B2 | 12/2009 | Elliott et al. | |
| 8,039,102 | B1 * | 10/2011 | Lavature | B32B 25/10 428/343 |
| 8,158,236 | B2 | 4/2012 | Liggett et al. | |
| 8,372,228 | B2 | 2/2013 | Citterio | |
| 8,420,164 | B2 | 4/2013 | Yamaguchi et al. | |
| 2004/0127614 | A1 | 7/2004 | Jiang et al. | |
| 2004/0258936 | A1 | 12/2004 | Yamaguchi et al. | |
| 2004/0265560 | A1 | 12/2004 | Sauer et al. | |
| 2005/0042444 | A1 | 2/2005 | Bohm et al. | |
| 2010/0227968 | A1 | 9/2010 | Joseph et al. | |
| 2011/0077347 | A1 * | 3/2011 | Reinartz | C08L 39/06 524/508 |
| 2011/0268945 | A1 | 11/2011 | Cawse | |
| 2011/0312238 | A1 | 12/2011 | Bader et al. | |
| 2012/0034833 | A1 | 2/2012 | Schaube et al. | |
| 2012/0174747 | A1 | 7/2012 | Hummel et al. | |
| 2012/0207966 | A1 | 8/2012 | Dickson | |
| 2013/0111640 | A1 | 5/2013 | Beth et al. | |
| 2013/0273341 | A1 | 10/2013 | Albertelli et al. | |
| 2014/0037883 | A1 | 2/2014 | Lavature | |
| 2014/0065907 | A1 | 3/2014 | Oktem et al. | |
| 2014/0230638 | A1 | 8/2014 | Waldrop | |
| 2014/0260937 | A1 | 9/2014 | Whitaker | |

FOREIGN PATENT DOCUMENTS

| | | | |
|---|---|---|---|
| EP | 0645415 | A1 | 3/1995 |
| WO | 2006049651 | A2 | 5/2006 |
| WO | 2011112590 | A2 | 9/2011 |
| WO | 2012007703 | A1 | 1/2012 |

OTHER PUBLICATIONS

International Search Report and Written Opinion of the International Search Authority dated Dec. 9, 2016, for corresponding International Application No. PCT/US2016/052449, filed Sep. 19, 2016 (9 pages).
"DuPont™ Kevlar® MTP for Multi Threat Protection—AS 400 Family", product summary description by DuPont International Operations Sàrl Kevlar® Life Protection, Le Grand Saconnex, Switzerland, downloaded from www,kevlar.com, first published Mar. 2008 (2 pages).
Invitation to Pay Additional Fees and Partial International Search Report, dated Dec. 1, 2014, by the International Search Authority, for corresponding International Application No. PCT/US2014/027906, filed Mar. 14, 2014 (4 pages).
International Search Report and Written Opinion of the International Search Authority, dated Jun. 24, 2015, for corresponding International Application No. PCT/US2014/027906, filed Mar. 14, 2014 (18 pages).
Office Action Rule 164(2)(b) and Article 94(3) EPC dated Jul. 19, 2018 for corresponding European Application No. 14 777 207.3 filed Oct. 13, 2015 (11 pages).
Non-final Office Action dated Sep. 20, 2018 in copending U.S. Appl. No. 14/212,070, filed Mar. 14, 2014 (11 pages).
U.S. Appl. No. 14/212,070, filed Mar. 14, 2014, Whitaker.

* cited by examiner

*Primary Examiner* — Arti Singh-Pandey
(74) *Attorney, Agent, or Firm* — Daniel F. Nesbitt; Hasse & Nesbitt LLC

(57) ABSTRACT

A flexible and malleable ballistic panel having an adhesive surface for bonding the ballistic shield to a substrate, the ballistic shield including a laminate of a plurality of ballistic-resistant layers comprising ballistic material, each the ballistic-resistant layer having a first inner surface and second outer surface, and a plurality of bonding layers comprising bonding butyl rubber material, each bonding layer having a first inner surface and second outer surface, at least one of the bonding layer being an inner-most layer of the laminate, and each ballistic-resistant layer having a bonding layer therebetween. The base layer of the ballistic shield is attached to the inner surface of the substrate to provide a reinforced substrate that improves the resistance to penetration of the reinforced substrate by a ballistic projectile.

20 Claims, 20 Drawing Sheets

FLEXIBLE ADHESIVE BALLISTIC SHIELD

CROSS-REFERENCE TO RELATED APPLICATIONS

This application is a continuation-in-part application of U.S. application Ser. No. 14/212,070, filed Mar. 14, 2014, which claims the benefit of U.S. Provisional application 61/788,459, filed Mar. 15, 2013, the disclosures of which are incorporated by reference in their entireties.

FIELD OF THE INVENTION

The present invention relates to a ballistic panel

BACKGROUND OF THE INVENTION

Bullet-proofing materials are known and have been used to protect vehicles, facilities, equipment and personnel. Armor for resisting gunfire or explosions is very difficult, heavy and takes a lot of time and planning to install. Soldiers and security officers in the field often find themselves utilizing stock, civilian vehicles or inadequately armored vehicles offering little to no protection. Most armoring has to be built into the vehicle as it is produced at the factory or weeks of adapting armor by major disassembly and reassembly.

A similar problem exists in architectural situations. Because of the complexity and time involved, armoring is often not installed. This invention allows anyone with minimal mechanical skills to apply a bullet resistant material very quickly and easily. A stock vehicle (including a new, used, leased or rented one) can receive armoring into the doors, floor, side panels and roof within hours and without highly skilled personnel.

U.S. Pat. No. 5,531,500, issued to Podvin, describes bullet-proofing panel for attachment to the exterior door surfaces of a police cruiser or the like, the panel having an outer polymeric skin having a contour corresponding to the contour of the sheet metal of the vehicle's doors. The polymeric skin member when affixed to the outer sheet metal panels of the vehicle's doors defines a predetermined space or pocket therebetween which contains a barrier member, preferably a woven KEVLAR® material, capable of stopping bullets from practically all handguns. Because the outer polymeric skin can be shaped to follow the contours of the original vehicle and painted to match, the bullet-proof panel does not detract from the overall ornamental appearance of the vehicle.

SUMMARY OF THE INVENTION

The present invention provides a flexible (and malleable) and adhesive ballistic shield or panel that includes one or more, and preferably a plurality of, layers of flexible, taskified rubber material, and one or more, and preferably a plurality of, layers of a ballistic fabric, positioned between layers of the flexible, taskified rubber material.

The present invention utilizes thin, alternating layers of certain aramid and ultra-high-molecular-weight polyethylene (UHMWPE) fibers, or other ballistic fabric, and of a tenacious bonding agent that can include a synthetic viscoelastic polymer, which is termed a bonding rubber material. The bonding rubber material can include either a butyl rubber comprising polyisobutene or a copolymer of isobutylene and isoprene, or an acrylic rubber. When the flexible and malleable adhesive ballistic shield or panel is applied by bonding or adhesion to a surface of a substrate, and typically a rigid or inflexible substrate, such as an automobile or vehicle body panel, wood, a construction wall or surface, etc., the resistance of the substrate to projectile penetration is significantly and dramatically increased.

Aramid fabric is known to be used in bullet proofing when it has a backing material (i.e., a human body), but have not proven to be effective inside of a wall or other substrate of a vehicle or a construction structure, including a vehicle side wall or any type of construction substrate or structure, presumably because the ballistic fabric has not been fastened adequately to the substrate or structure to keep the ballistic fabric from moving, and therefore limiting its ability to capture the projectile. The bonding rubber material provides fast and secure adhesion of the ballistic panel or shield to the inside surface of the substrate or structure (the inside surface being that surface of the substrate or structure that is on the human-occupancy side). The amount and thickness of the ballistic fiber material alone (that is, without the alternating layers of the flexible, tackified rubber) that is needed to stop a projectile is believed to be 3 to 10 times the amount of such ballistic fiber material when comprised in the ballistic shield or panel of the present invention.

The adhesion, cohesion and elasticity of layers of the bonding rubber material that attach the ballistic shield to the substrate and to the alternating layers of ballistic fabric significantly contributes to the "catching" of the projectile. The combination of the bonding rubber material layers and the ballistic fabric layers reduces or limits the deformation (and resulting penetration) of the ballistic shield, and of the original substrate (the vehicle panel or structural substrate) to which the ballistic shield has been adhesively applied.

The present invention provides a flexible and adhesive ballistic shield, having an adhesive surface for bonding the ballistic shield to a substrate. The ballistic shield can include at least a base layer of a bonding rubber material and at least a first layer of a ballistic fabric material disposed on an outer-facing surface of the base layer of bonding rubber material. Additional layers of ballistic fabric material can be applied with layers of the rubber material disposed therebetween. The bonding rubber material can comprise a butyl rubber selected from the group consisting of polyisobutene, a copolymer of isobutylene and isoprene, and a combination thereof. The bonding rubber material can also comprise an acrylic rubber.

The bonding rubber material can further comprises a plasticizer or a tackifying agent, carbon black, and a filler material.

The present invention provides a flexible ballistic shield having an adhesive surface for bonding the ballistic shield to a substrate, the ballistic shield comprising at least a base layer of a bonding butyl rubber material and at least a first layer of a ballistic fabric material disposed on an outer-facing surface of the base layer of bonding butyl rubber material, the inner-facing surface of the base layer providing the adhesive surface of the ballistic shield, the bonding butyl rubber material comprising: a butyl rubber selected from the group consisting of polyisobutene, a copolymer of isobutylene and isoprene, and a combination thereof, for attaching the ballistic shield to a substrate of a vehicle or structure.

As used herein, an inner layer or an inner-facing surface of a layer refers to the direction or position of a surface or layer towards the base layer of the bonding rubber material that attaches the ballistic shield to the substrate or structure, while an outer layer or outermost layer, or outer surface or outermost surface, of a layer refers to the direction or position of a surface or layer that is remote (or most remote) or away from the base layer of the bonding rubber material.

The bonding rubber material includes a cross linked acrylic or a cross-linked butyl rubber that provides cohesive properties to maintain the integrity of the adhesive or attachment of the bonding rubber material with the ballistic fabric layers, to reduce and minimize the separation of the layers when subjected to the forces of the high-velocity projectiles. A butyl rubber can include butyl rubber comprising a polyisobutene or a copolymer of isobutylene and isoprene, or an acrylic rubber. The butyl rubber can include a cross-linked butyl rubber material. The butyl rubber or the acrylic rubber can comprise about 5% to about 60%, including about 10% to about 40%, and further including about 10% to about 20%, of the bonding rubber material.

The bonding rubber material also includes a tackifying agent and/or a plasticizer that provides flexibility, tack, adhesion, and extends the life of these properties in the layers of the bonding rubber material, so that the applied ballistic shield maintains its performance over time. Non-limiting examples including a polybutene, a polypropene, a paraffinic oil, a petrolatum, a phthalate, and a one or more resins selected form the group consisting of a polyterpene, a terpene-phenolic, a blocked-phenolic, a modified rosin or rosin ester, a cumarone-indene resin, a styrene resin, and a hydrocarbon resin. The tackifier and/or plasticizer should be compatible with the butyl rubber or acrylic rubber material. Preferred tackifiers and/or plasticizers are a polybutene, a hydrocarbon resin, a phenolic resin, or a combination thereof. The kind and quantity of tackifiers used should be chosen to provide adequate adhesion and plasticity across the anticipated range of temperatures to which the adhesive will be exposed. The tackifier and/or plasticizer agent can comprise about 10% to about 40%, including about 15% to about 30%, and further including about 20% to about 30%, of the bonding rubber material.

The bonding rubber material can also include one or more reinforcing or filler agents. Examples include a finely divided carbon, such as carbon black, aluminum hydrate, clays, hydrated silicas, calcium silicates, silicoaluminates, magnesium oxide, magnesium carbonate, mica, lime, and talc. The reinforcing or filler agents can comprise about 20% to about 80%, including about 40% to about 70%, and further including about 50% to about 60%, of the bonding rubber material. The carbon black can comprise about 5% to about 30%, including about 20% to about 25%, of the bonding rubber material.

The ballistic shield can include at least two layers of the bonding rubber material, including the base layer and a second layer, with the first layer of ballistic fabric material disposed between the at least two layers of the bonding rubber material, and including a second layer of ballistic fabric material disposed on an outer surface of the second layer of bonding rubber material. The ballistic shield can further including one or more additional layers of bonding rubber material, and one or more additional layers of ballistic fabric material, disposed between successive layers of the bonding rubber material. The ballistic shield can further including a handling fabric layer disposed on an outer surface of an outermost layer of bonding rubber material. The ballistic shield can further including a releasable protective layer on an inner-most surface of the base layer of bonding rubber material, to protect such inner-most surface of the base layer from particulate contamination prior to use of the flexible ballistic shield. The ballistic material can be is a ballistic fabric, including a ballistic fabric made from ballistic fibers selected from the group consisting of aramid fibers and ultra-high-molecular-weight polyethylene (UHM-WPE) fibers, and including Kevlar®@, Dyneema®, and other aramid fiber. The ballistic fabric provide flexibility and improved handling and use of the flexible ballistic shield.

The present invention also provides a method of applying a flexible ballistic shield to the inside surface of a resilient or rigid wall or structure, comprising the steps of: (i) providing a ballistic shield or a flexible ballistic shield according to any embodiment of the invention; (ii) attaching an inner-facing surface of the base layer of bonding rubber material of the ballistic shield to an inside surface of a wall or structure; and (iii) applying pressure to the outer surface of the ballistic shield sufficient to adhere the ballistic shield to the wall or structure surface. Heat can also be applied to the adhesively-applied ballistic shield or to the inside surface of the wall or structure, to improve adherence of the butyl rubber layer to the wall or structure, and further improve penetration of the bonding rubber material into the ballistic fabrics.

The present invention also provides a flexible ballistic panel having an adhesive surface for bonding the ballistic shield to a substrate, the ballistic shield comprising a laminate of a plurality of ballistic-resistant layers comprising ballistic fabric, each the ballistic-resistant layers having a first inner-facing surface and a second outer-facing surface, and a plurality of bonding layers comprising a bonding rubber material, each bonding layer having a first inner-facing surface directed toward the substrate and a second outer-facing surface directed away from the substrate, at least one of the bonding rubber material layers being an inner-most layer of the laminate, and each ballistic-resistant layer having a bonding rubber material layer therebetween. The ballistic fabric can be a woven ballistic material. The bonding layer typically consists essentially of a bonding butyl rubber material comprising: a butyl rubber selected from the group consisting of polyisobutene, a copolymer of isobutylene and isoprene, and a combination thereof; a plasticizer or a tackifying agent; carbon black; and a filler material. An outmost layer is a fabric, including a ballistic fabric or a non-ballistic handling fabric.

The present invention also provides a method of making a ballistic panel comprising the steps of: a. providing a plurality of ballistic-resistant layers comprising ballistic fabric material, b. providing a plurality of bonding layers comprising a bonding rubber material, c. forming a stack comprising alternating layers of the ballistic-resistant layers and the bonding rubber material layers, and d. applying pressure and optionally heat to the stack to and adhere the plurality of bonding layers to the plurality of ballistic-resistant layers. An end-most bonding layer can be covered by a release layer material for handling purposes.

The present invention also provides a method of making a ballistic panel comprising the steps of: a. providing a plurality of ballistic-resistant layers comprising ballistic fabric material, b. providing a plurality of bonding rubber material layers comprising a bonding butyl rubber material comprising: a butyl rubber selected from the group consisting of polyisobutene, a copolymer of isobutylene and isoprene, and a combination thereof; a plasticizer or a tackifying agent; carbon black; and a filler material, c. forming a stack comprising alternating layers of the ballistic-resistant layers and the bonding rubber material layers, and d. applying pressure to the stack to adhere the plurality of bonding rubber material layers to the plurality of ballistic-resistant layers.

The present invention further includes a method of ballisticly-reinforcing a substrate on a human-occupancy side of the substrate, comprising the steps of: a) providing a substrate having an inner surface that faces a defined human-occupancy side, b) providing a flexible ballistic shield according to any embodiment of the present invention; c) attaching adhesively the base layer of the flexible ballistic shield to the inner surface of the substrate to provide a reinforced substrate, wherein the adhesive attachment of the flexible ballistic shield improves the resistance to penetration of the reinforced substrate by a ballistic projectile.

In an example of the invention, a laminated ballistic panel applied to a 20 gauge-thick steel panel successfully stopped 9 mm bullets with complete success, with no penetration. In another example, a laminated ballistic panel applied to a 20 gauge-thick steel panel stopped a 45 caliber bullet with no penetration.

BRIEF DESCRIPTION OF THE FIGURES

FIGS. 8A-33*b* show test results for various ballistic panels made by alternating layers of a butyl rubber and ballistic fabrics, adhered to steel plating, fired from a distance of 30 feet using different caliper firearms.

FIGS. 8A and 8B show a 20 gauge steel panel shot with both 9 mm projectiles and 38 caliper projectiles.

FIGS. 33A and 33B show a 20 gauge steel panel with three layers of butyl and PE UD 35 shot with 9 mm projectiles.

DETAILED DESCRIPTION OF THE INVENTION

Figure 2:
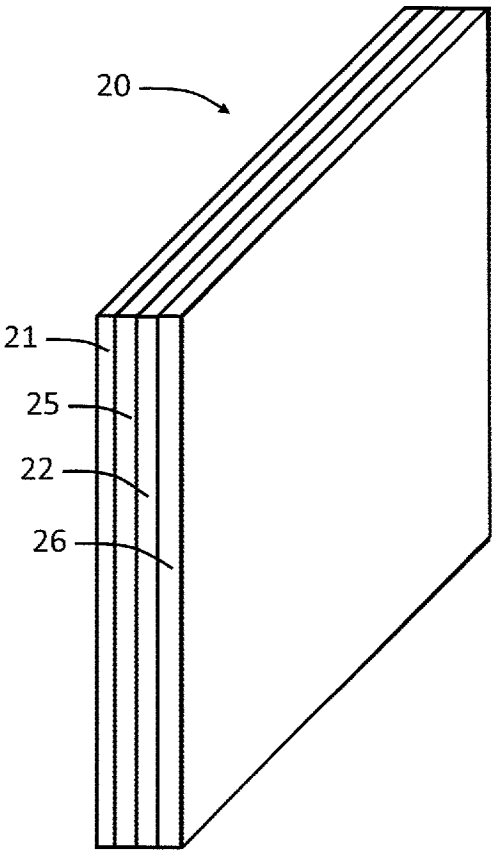
FIG. 2 shows a ballistic panel having two bonding layers including an innermost bonding layer, and two ballistic-resistant layers between the bonding layers.

There is well established wide spread use of peel and stick sound deadener by automotive shops and do-it-yourself (DIY) consumers that suggest to the inventor the feasibility of a similarly applied product having armor and ballistic materials.

A small projectile at a high velocity is one of the most difficult to stop. Bulletproof vests protect human bodies from the penetration of bullets, using ballistic fabrics of woven material that can catch the projectile. A much smaller projectile, or a sharpened object, can penetrate such vests because the tip can penetrate between the woven fibers. A bulletproof vest does function by using the human body behind the vest to absorb the blunt force trauma of the bullet, because there the ballistic fabric itself cannot oppose the force of the projectile, and the ballistic fabric itself is forced out of the path of the projectile unless supported or provided with structural integrity. The bonding rubber material used to bond together the aramid fabric layers, and to adhere the ballistic shield panels to the substrate significantly impacts the ballistic performance. The alternating layers of ballistic fabric and bonding rubber material are tenaciously adhered to the back-side (the side opposite the side of projectile penetration) of the substrate through the tackified, flexible bonding rubber material, thereby using the structural integrity of the substrate itself to hold the ballistic fabrics in place and in lamination, even though the substrate or structure is not "backing up" the ballistic shield.

The bonding material is preferably selected from butyl rubber and polyisobutylene. The bonding materials provide adhesion, cohesion, viscosity, density, elasticity, formability and deformability, at a minimal thickness and weight, when layered with the ballistic layers. Typical bonding layer thickness is from about 0.5 mm and thicker, including at least about 1 mm, at least about 2 mm, at least about 3 mm, at least about 4 mm, and at least about 5 mm, and up to about 10 mm, including up to about 8 mm, up to about 6 mm, up to about 1 mm, and up to about 4 mm.

The bonding rubber material has a tensile strength, an elongation, a modulus at 300% elongation, a modulus at failure, a shear strength, and a peel strength sufficient to adhere to the substrate or structure, to resist delamination from the substrate and the ballistic fabric, as applied and under most all environmental conditions, and under the force of ballistic projectiles.

Tensile strength refers to the maximum stress (force per unit area) that a specimen of adhesive material can withstand before rupturing. Elongation measures the relative increase in length of a specimen of material at the point of rupture. The modulus at 300% elongation is the force required to stretch a sample of the adhesive to an elongation of 300% divided by the elongation of the sample expressed as a decimal rather than as a percentage. The modulus at failure is the tensile strength divided by the elongation. The bonding rubber material can be compounded to have a tensile strength of at least 50 psi, and more preferably at least 60 psi; an elongation of at least 600%, and more preferably of at least 800%, and even preferably more than 1000%; a modulus at 300% elongation of less than 12, preferably of at most 8; and a modulus at failure of less than 20, preferably of at most 16.

The adhesive composition also preferably has a peel strength of at least 2 pounds per inch and a sheer strength of at least 15 psi. The shear strength and peel strength relate to the ability of the adhesive to adhere to a substrate or structure.

Figure 1:
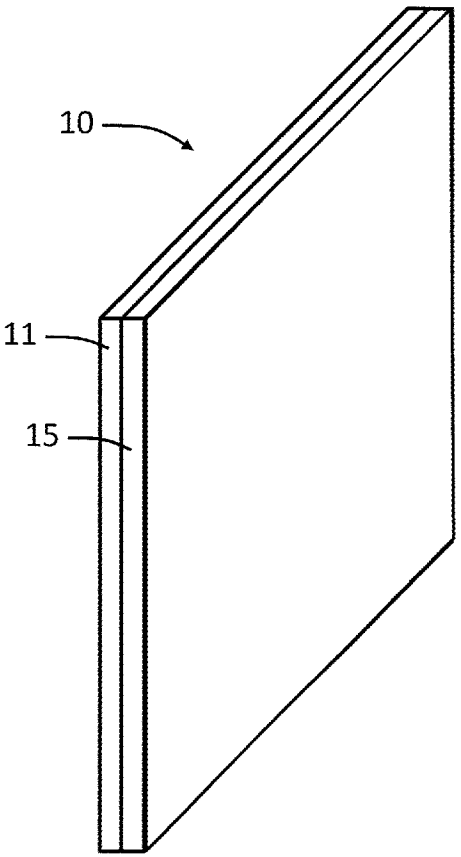
FIG. 1 shows a ballistic panel having an innermost bonding layer and a ballistic-resistant layer.
Figure 4:
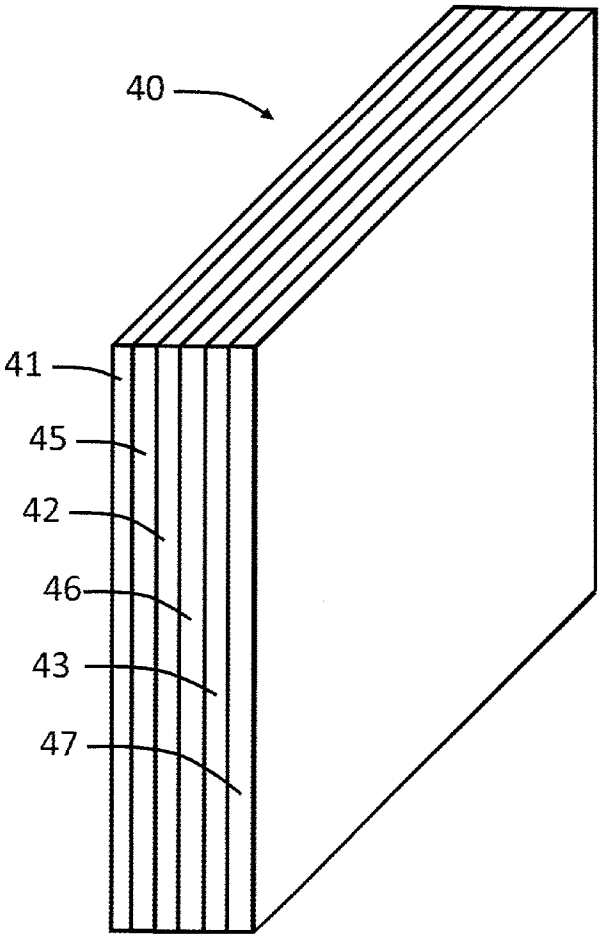
FIG. 4 shows a ballistic panel having three bonding layers including an innermost bonding layer, and three ballistic-resistant layers between the bonding layers.
Figure 3:
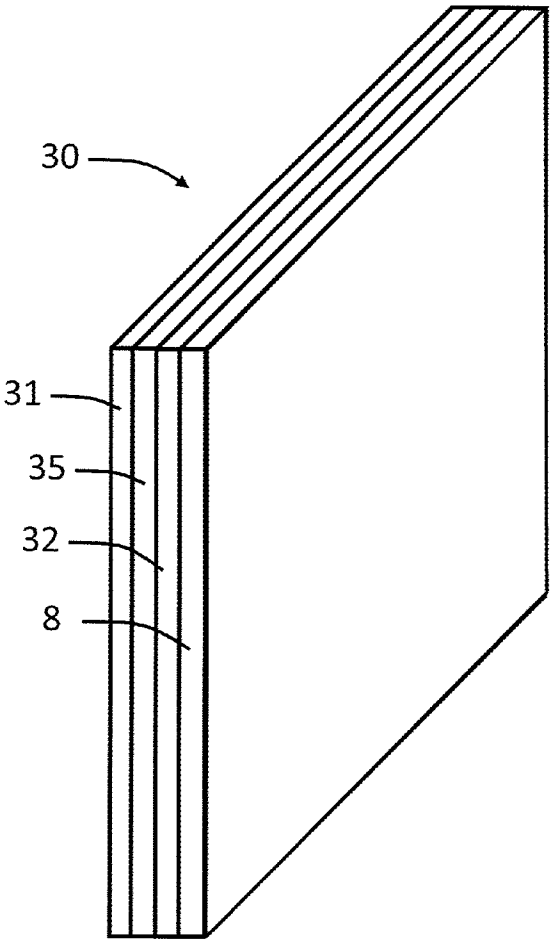
FIG. 3 shows a ballistic panel having two bonding layers including an innermost bonding layer, a ballistic-resistant layers between the bonding layers, and an outermost handling fabric layer.
Figure 6:
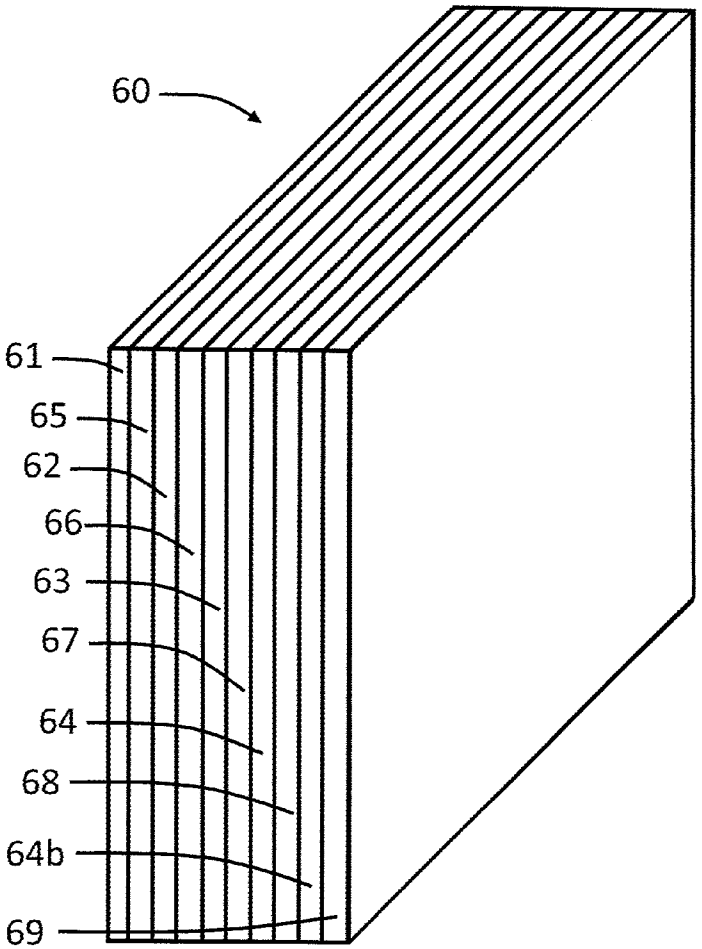
FIG. 6 shows a ballistic panel having five bonding layers including an innermost bonding layer, and five ballistic-resistant layers between the bonding layers.
Figure 5:
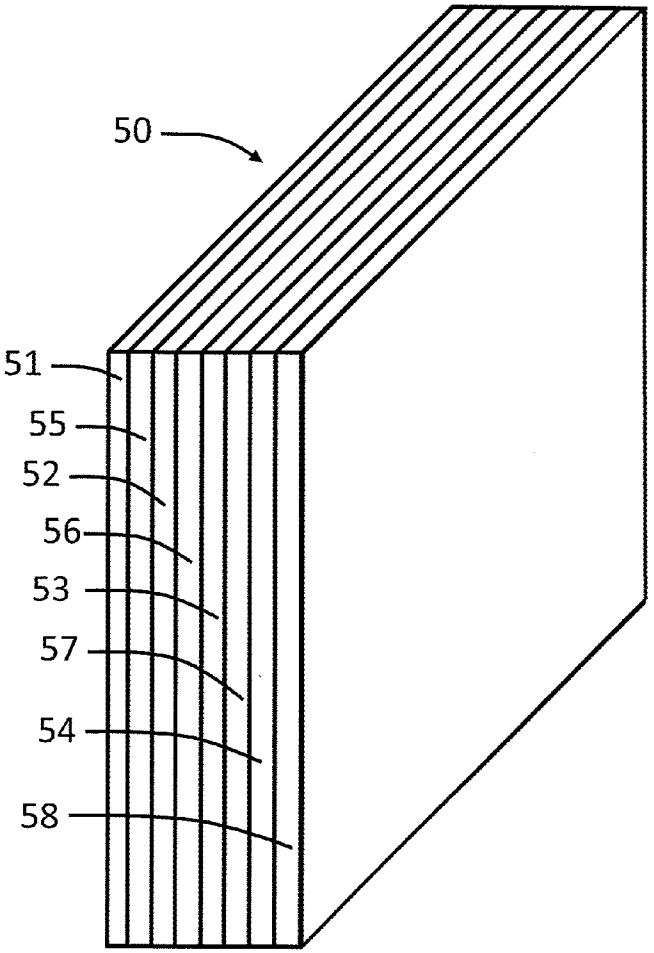
FIG. 5 shows a ballistic panel having four bonding layers including an innermost bonding layer, and four ballistic-resistant layers between the bonding layers.

FIG. 1 shows a ballistic panel 10 having a single ballistic layer, including an innermost layer of butyl rubber 11 and a layer of ballistic fabric 15. FIG. 2 shows a ballistic panel 20 having two ballistic layers, including an innermost layer of butyl rubber 21 and a second butyl layer 22 sandwiched between two ballistic fabric layers 25 and 26. FIG. 3 shows a ballistic panel 30 having a single ballistic layer 35 and a handling fabric layer 8, with an innermost layer of butyl rubber 31 and a second butyl layer 32 sandwiched between the ballistic fabric layer 35 and the handling fabric layer 8, which can be a non-ballistic fabric. FIGS. 4-6 show ballistic panel laminates have three, four, and five layers each of the ballistic fabrics and butyl rubber.

Figure 7:
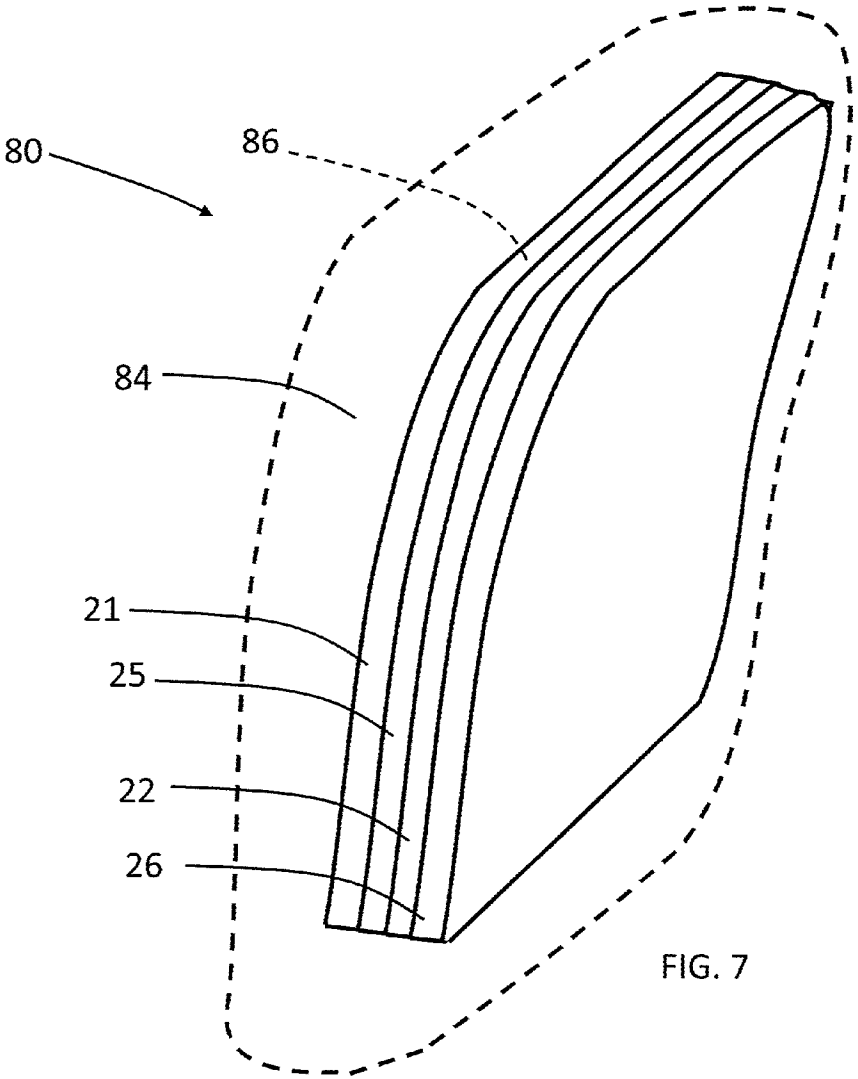
FIG. 7 shows the ballistic panel of FIG. 2 bonded to the inner surface of a substrate.

FIG. 7 shows the ballistic panel 70 of FIG. 2 having two ballistic layers 75 and 76, which is formed into a ballistic shield 80 having an innermost butyl layer 71 that adheres to the inside surface 86 (opposite the expected projectile penetration side) of the substrate 84.

The alternating layers of ballistic materials can be selected of any material that can be bonded together in a laminate by the bonding layers, and can include sheets of metals including steel, stainless steel, aluminum, and others, sheets of carbon fiber fabrics and materials, and ballistic fabrics including aramid fabrics including Kevlar® and Dyneema®, and others, and high impact plastic layers, including ultra-high-molecular-weight polyethylene (UHMWPE, UHMW), and UHMWPE containing carbon nanotubes, and combinations thereof.

Another feature of the claimed invention is a flexible and malleable ballistic panel that can be formed to any panel shape for adhesion to a substrate of a wide variety of shapes. The adhesive, cohesive and elastic qualities of the bonding material provide flexibility to the panel, and an effective adhesive surface that adheres tenaciously to metal, wood and other substrate surfaces. Use of release layers produces an effective "peel and stick", quick and easy application, and a highly effective projectile resistant barrier. Non-limiting examples of release layers are films of a silicon, a polycarbamate, or a polyolefin, including polyethylene. The ballistic panel can be made by forming a stack of alternating layers of the ballistic fabric material and the bonding rubber material layer, and applying pressure to the stack transverse to the stack surface to cause the bonding layers to adhere by penetration of the bonding material into the fabric and threads ballistic material.

The pressure can be applied to speed and aid the depth of penetration, typically at least about 1 psi. Heat can also be applied, before or during the pressure, to further aid penetration. The tackiness and flowability of the bonding rubber material can penetration of the fabric material and flow between and around individual the fibers of the ballistic fabric. The penetration of the bonding rubber material into the ballistic fiber may be substantially complete, in which at least about 90% of the fibers in the ballistic fabric are contacted by the bonding rubber material, or a majority of the fibers in ballistic fabric are contacted by the bonding rubber material, or as few as about 10% or less of the fibers in the ballistic fabric are contacted by the bonding rubber material. The extent of the wet out is influenced by the specific fiber of the ballistic fabric, and the pressure and temperature applied to the stack of alternating layers of the ballistic fabric material and the bonding rubber material layers. Typically the butyl or acrylic rubber material will not run or flow out from the ballistic fabrics unless dissolved in a solvent.

When formed, at least one of the outer-most layers is the butyl or acrylic rubber material. For manufacture and transport of the panels, a release layer of a plastic film placed over the outer-most butyl layer prevents dust, dirt and other contaminants from adhering to the butyl surface, and from the tackiness of the butyl rubber from contacting hands, packaging and other surfaces. The process can be batch or continuous stacking, heating pressurizing and packaging.

When applying the ballistic panel to the surface of a substrate, the surface of the substrate should be carefully cleaning of dirt, debris, and liquids, and in particular removing any traces of oily material, to improve adherence of the bonding rubber material panels, and thus the ballistic performance of ballistic shield panels. Surface preparation of the substrate includes cleaning, degreasing, oil stripping, and roughing of the surface including sanding.

Examples

Ballistic panels were made by alternating layers of a bonding butyl rubber material and ballistic fabrics. The ballistic fabrics included an aramid fiber fabric (Kevlar®) and an ultra-high molecular weight polyethylene fiber fabric (Dyneema®), and UD Fabric of various denier (fabric weights). The composition of the bonding butyl rubber material is shown in Table A. The panels were adhered to 20 gauge steel panels (6 inch×9 inch) with heat and pressure treatment, and fixed mounted. Bullets of various caliber and power were fired from a distance of 30 feet at the mounted panels, including 9 mm, 38 caliper, and 45 caliper firearms, and the results noted.

TABLE A

| Component | Percentage by weight |
|---|---|
| cross linked butyl rubber | 5% |
| blended butyl rubber | 5% |
| carbon black | 20% |
| polybutene (plasticizer/tackifier) | 15% |
| hydrocarbon resin | 5% |
| inert fillers (including mica, silica, lime, and talc) | 49% |
| other minor components | 1%. |

FIGS. 8A-33B show the conditions and results of the tests.

Figure 8A:
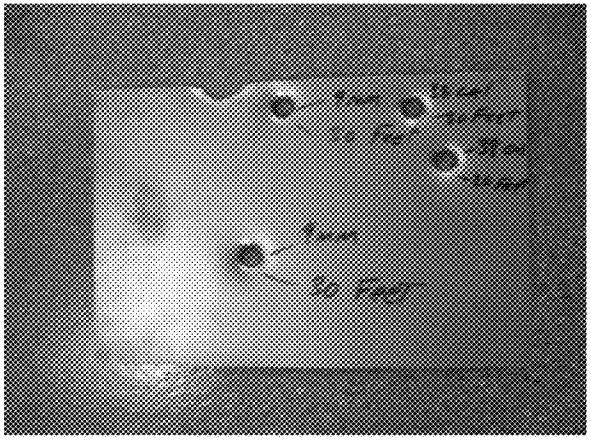

FIG. 8A shows the front surface of a 20 gauge steel panel shot from 30 feet with both 9 mm projectiles and 38 caliper projectiles into the front surface.

Figure 8B:
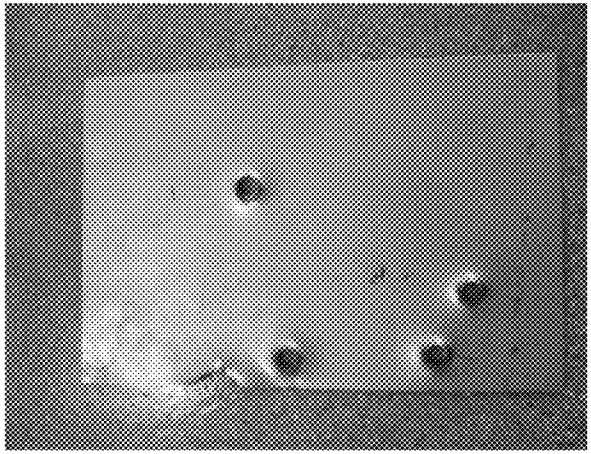

FIG. 8B shows the back surface of the 20 gauge steel panel of FIG. 8A.

Figure 9A:
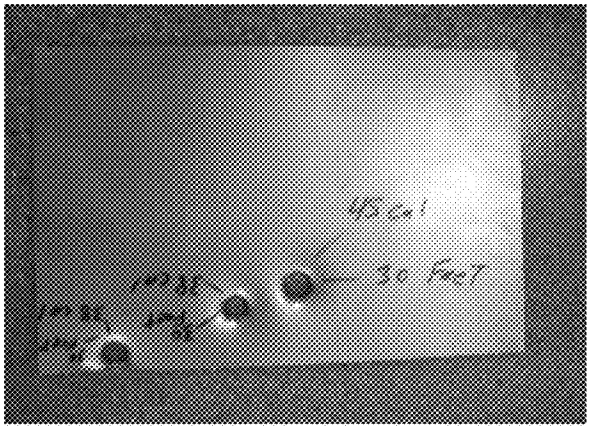
FIGS. 9A and 9B show a 20 gauge steel panel shot with both 45 caliper projectile and 38 caliper projectiles.

FIG. 9A shows the front surface of a 20 gauge steel panel shot from 30 feet with both 45 caliper projectile and 38 caliper projectiles passing through the front surface.

Figure 9B:
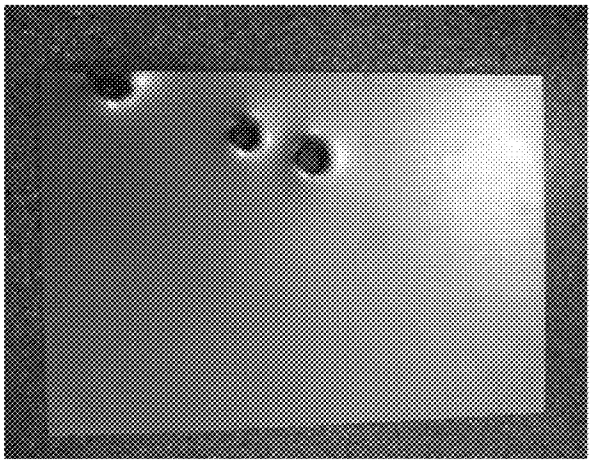

FIG. 9B shows the back surface of the 20 gauge steel panel of FIG. 9A.

Figure 10A:
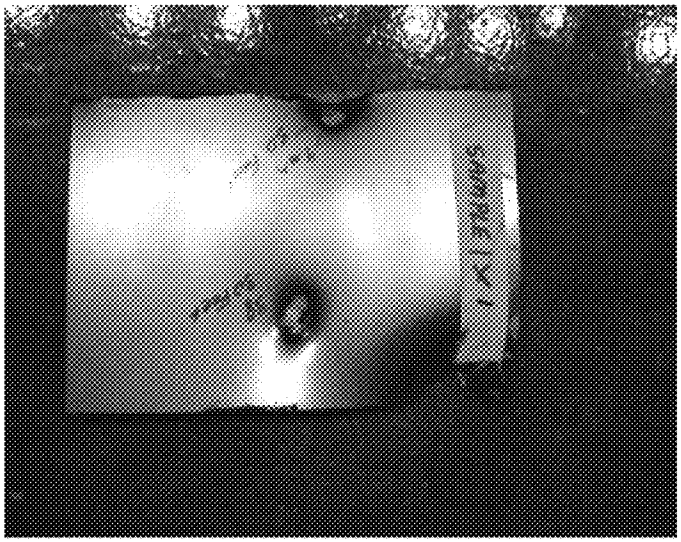
FIGS. 10A through 10C show a 20 gauge steel panel with a layer of butyl and PE UD Fabric 170 shot with 9 mm projectiles and 38 caliper projectiles.

FIG. 10A shows the front surface of a test panel, a 6 inch×9 inch 20 gauge steel panel, with its back covered with one (1) layer of butyl and one (1) layer of PE UD Fabric 170, which is a rayon/polyester with a density of 170 gm/m$^2$ and a yarn count of 32-43, made by Qianglun (China). The panel was shot from 30 feet with both 9 mm projectile(s) and 38 caliper projectile(s) into the front surface.

Figure 10B:
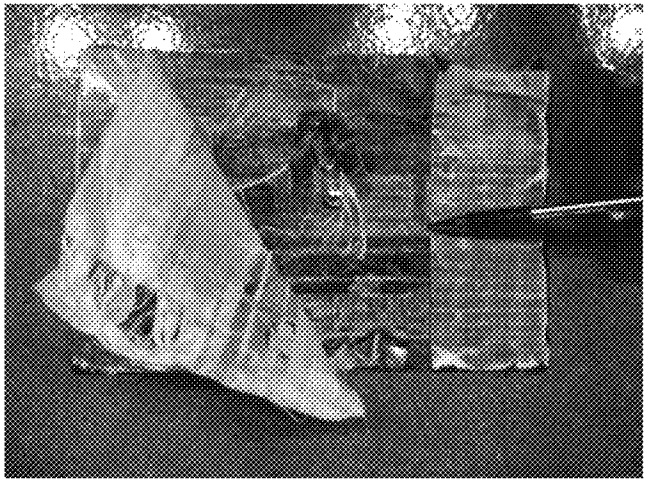
Figure 10C:
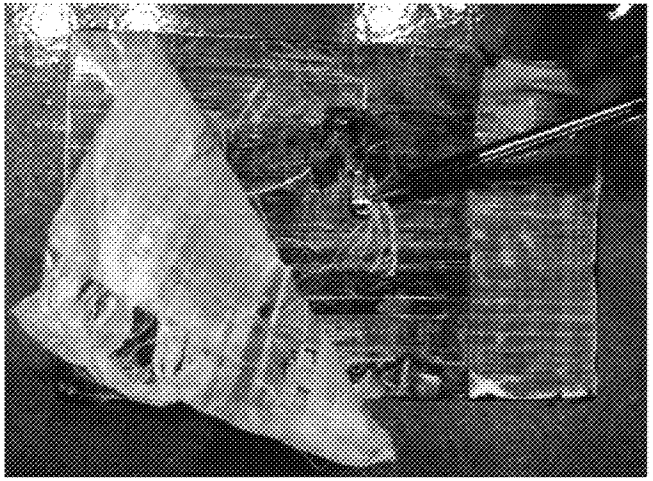

FIGS. 10B and 10C show the back surface of the 20 gauge steel panel of FIG. 10A. The back layer appears to show a failure of adhesion, with delamination of the fabric. The projectiles appear to show a can-opening effect on the metal plate that did not cut the fabric, but the fabric failed in a straight-across, perfectly straight horizontal line.

Figure 11A:
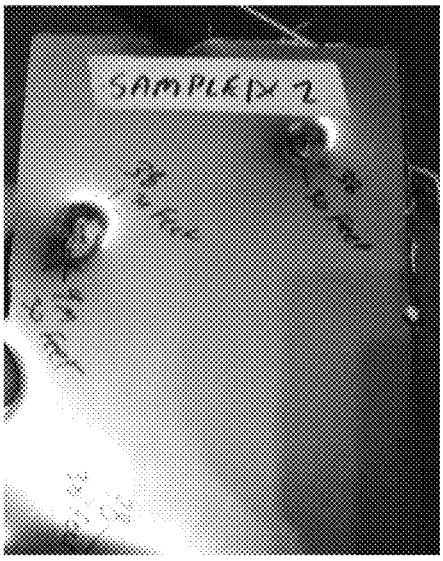
FIGS. 11A through 11E show a 20 gauge steel panel two layers of butyl and PE UD Fabric 170 shot with both 9 mm and 38 caliper projectiles.
Figure 11C:
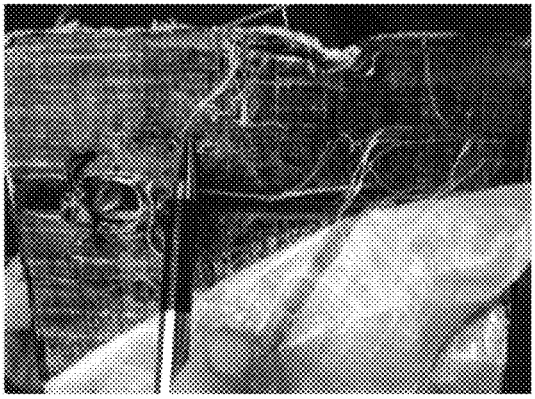
Figure 11D:
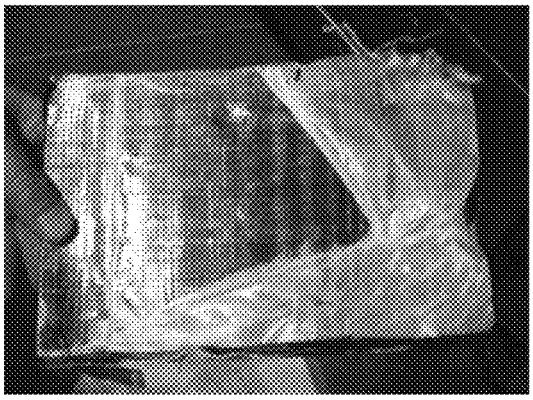
Figure 11B:
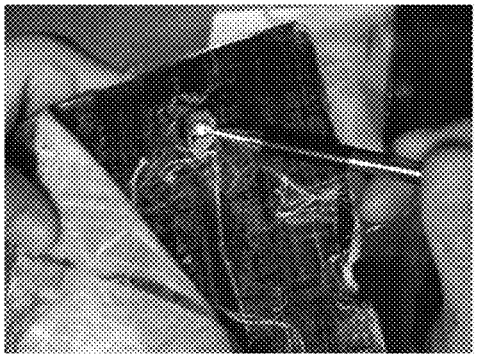
Figure 11E:
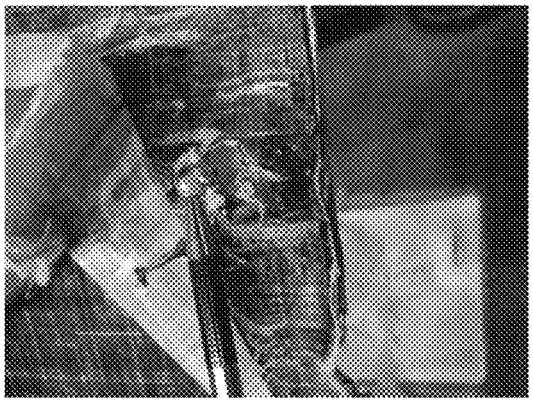

FIG. 11A shows the front surface of a test panel, a 6 inch×9 inch 20 gauge steel panel, with its back covered with two (2) layers of butyl and two (2) layers of PE UD Fabric 170. The panel was shot from 30 feet with both 9 mm projectile(s) and 38 caliper projectile(s) into the front surface.

FIGS. 11B, 11C, 11D and 11E show the back surface of the 20 gauge steel panel of FIG. 11A. The back layer appears to show delamination of the fabric. The projectiles appear to show a can-opening effect on the metal plate that ripped the fabric, but the fabric had no horizontal tearing.

Figure 12A:
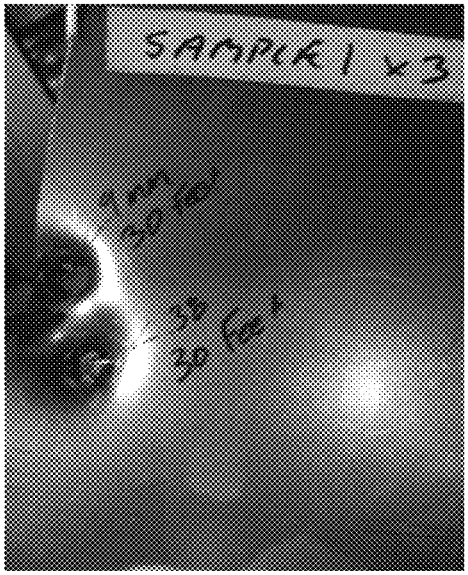
FIGS. 12A through 12D show a 20 gauge steel panel with three layers of butyl and PE UD Fabric 170 shot with both 9 mm and 38 caliper projectiles.

FIG. 12A shows the front surface of a test panel, a 6 inch×9 inch 20 gauge steel panel, with its back covered with three (3) layers of butyl and three (3) layers of PE UD Fabric 170. The panel was shot from 30 feet with both 9 mm projectile(s) and 38 caliper projectile(s) into the front surface.

Figure 12B:
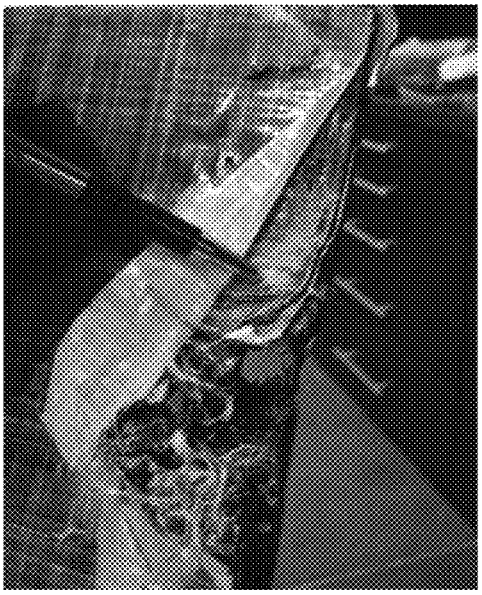
Figure 12C:
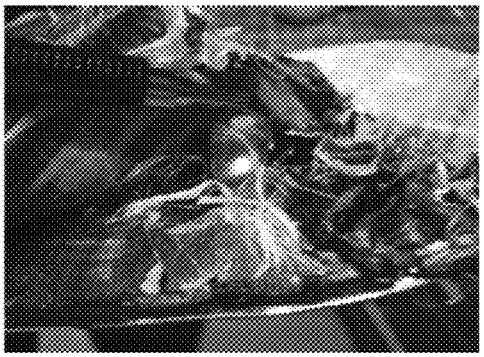
Figure 12D:
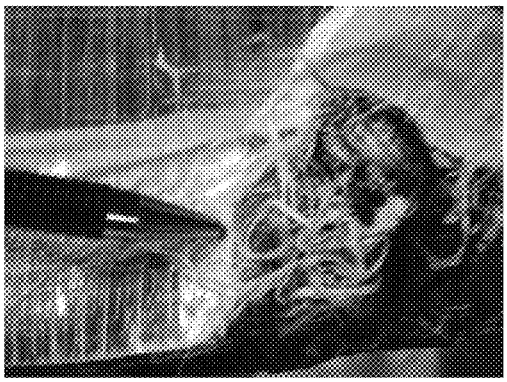

FIGS. 12B, 12C, and 12D show the back surface of the 20 gauge steel panel of FIG. 12A. The back layer appears to show delamination of the fabric with horizontal tearing. The projectiles appear to show a can-opening effect on the metal plate.

Figure 13A:
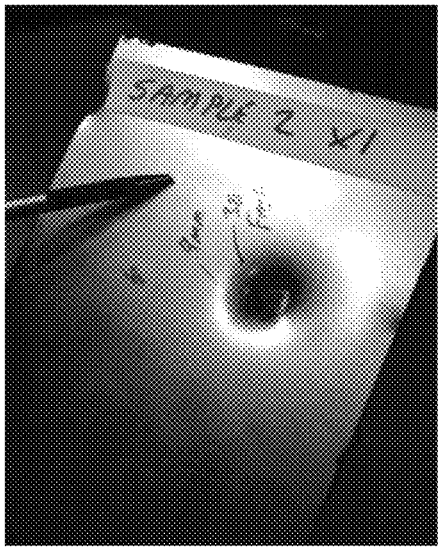
FIGS. 13A and 13B show a 20 gauge steel panel a layer of butyl and PE UD Fabric 140 shot with 9 mm projectiles.

FIG. 13A shows the front surface of a test panel, a 6 inch×9 inch 20 gauge steel panel, with its back covered with one (1) layer of butyl and one (1) layer of PE UD Fabric 140, which is a rayon/polyester with a density of 140 gm/m$^2$ and a yarn count of 32-42, made by Qianglun (China). The panel was shot from 30 feet with 9 mm projectile(s) into the front surface.

Figure 13B:
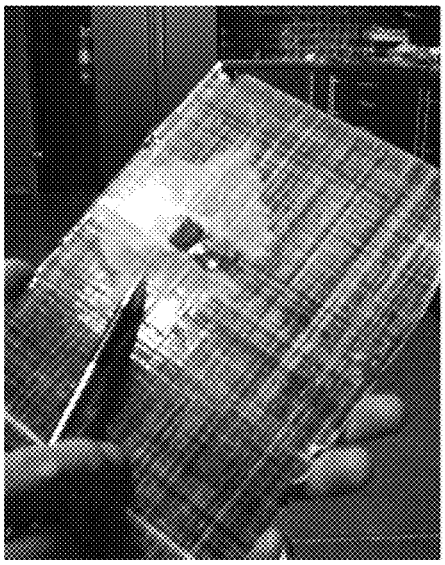

FIG. 13B shows the back surface of the 20 gauge steel panel of FIG. 13A. The back layer appears to show the start of delamination of the fabric with a perfect hole in the fabric.

Figure 14A:
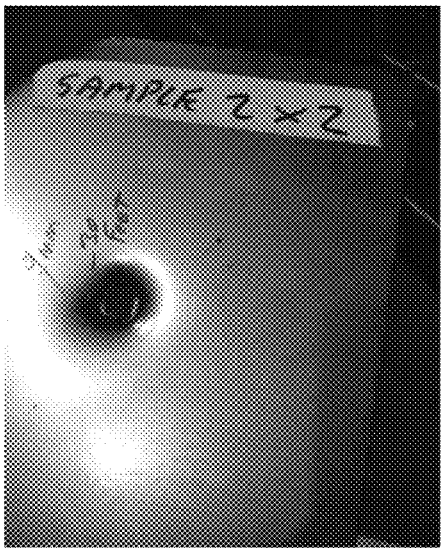
FIGS. 14A and 14B shows a 20 gauge steel panel with two layers of butyl and PE UD Fabric 140 shot with 9 mm projectiles.

FIG. 14A shows the front surface of a test panel, a 6 inch×9 inch 20 gauge steel panel, with its back covered with two (2) layers of butyl and two (2) layers of PE UD Fabric 140. The panel was shot from 30 feet with 9 mm projectile(s) into the front surface.

Figure 14B:
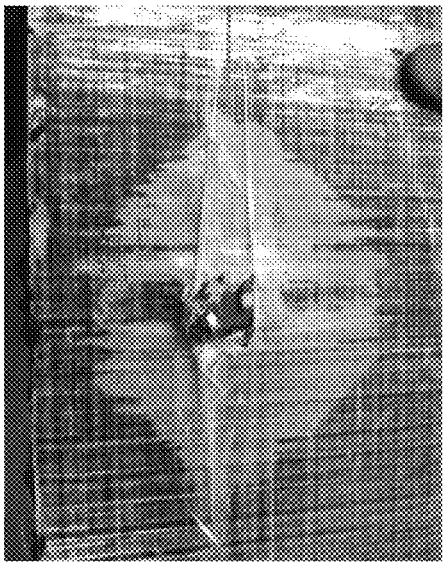

FIG. 14B shows the back surface of the 20 gauge steel panel of FIG. 14A. The back layer appears to show the start of delamination of the fabric with a perfect hole in the fabric.

Figure 15A:
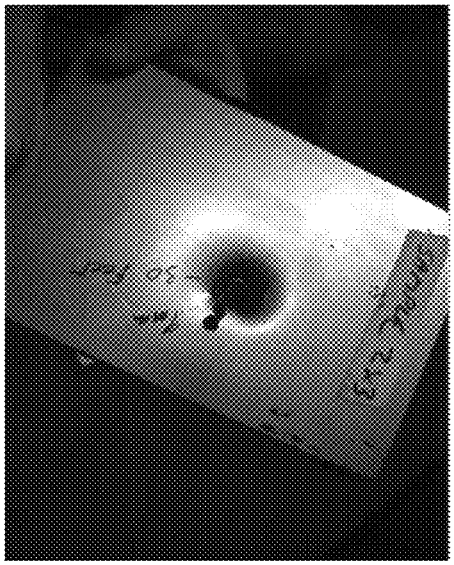
FIGS. 15A, 15B and 15C show a 20 gauge steel panel with three layers of butyl and PE UD Fabric 140 shot with 9 mm projectiles.

FIG. 15A shows the front surface of a test panel, a 6 inch×9 inch 20 gauge steel panel, with its back covered with three (3) layers of butyl and three (3) layers of PE UD Fabric 140. The panel was shot from 30 feet with 9 mm projectile(s) into the front surface.

Figure 15B:
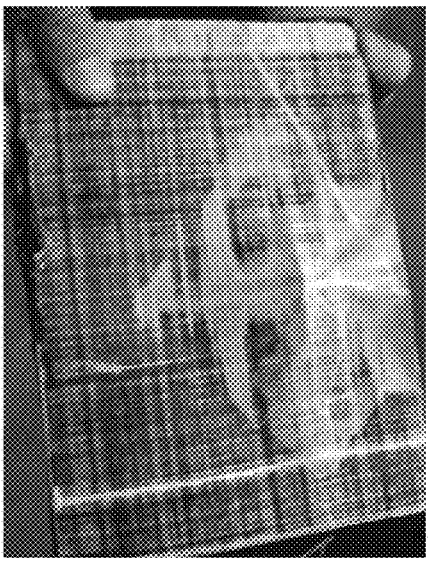
Figure 15C:
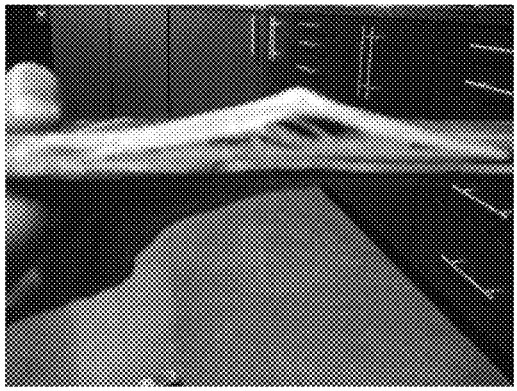

FIG. 15B shows the back surface of the 20 gauge steel panel of FIG. 15A. The back layer appears to show a can-opening effect on the metal plate, and the start of delamination of the fabric, but not penetration of the third layer. FIG. 14C shows that the bullet dropped out of the bottom of the panel.

Figure 16A:
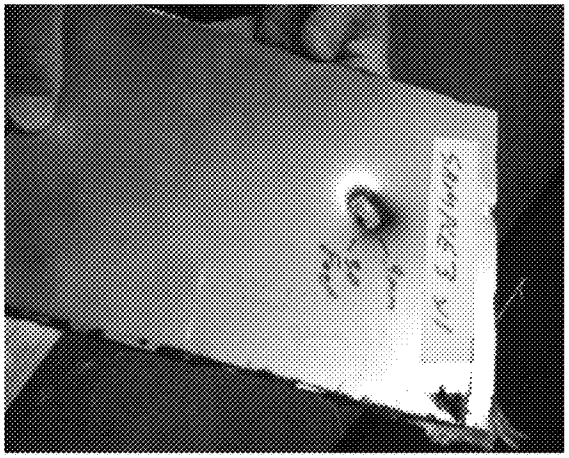
FIGS. 16A and 16B show a 20 gauge steel panel with one layer of butyl and Kevlar® 29 Denier 1500 shot with 9 mm projectiles.

FIG. 16A shows the front surface of a test panel, a 6 inch×9 inch 20 gauge steel panel, with its back covered with one (1) layer of butyl and one (1) layer of Kevlar® 29 Denier 1500, an aramid fabric with a density of 200 gm/m$^2$. This fabric adhered to the butyl layer very well. The panel was shot from 30 feet with 9 mm projectile(s) into the front surface.

Figure 16B:
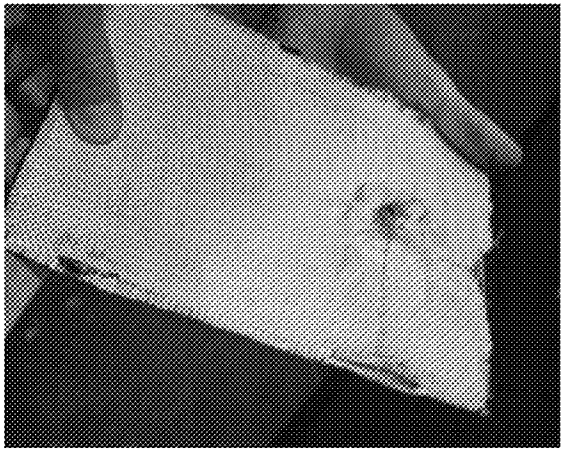
Figure 17A:
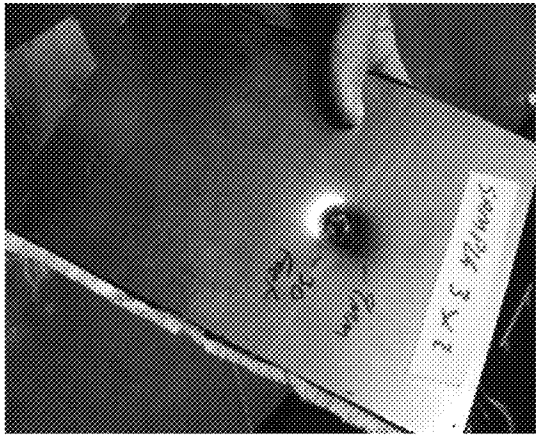
FIGS. 17A and 17B show a 20 gauge steel panel with two layers of butyl and Kevlar® 29 Denier 1500 shot with 9 mm projectiles.

FIG. 16B shows the back surface of the 20 gauge steel panel of FIG. 16A. The back layer appears to show a can-opening effect on the metal plate, and the bullet penetrating through every layer, with windowing of the fabric, which is the separation between the threads of the woven fabric that allows the bullet to pass through FIG. 17A shows the front surface of a test panel, a 6 inch×9 inch 20 gauge steel panel, with its back covered with two (2) layers of butyl and two (2) layers of Kevlar® 29 Denier 1500. The panel was shot from 30 feet with 9 mm projectile(s) into the front surface.

Figure 17B:
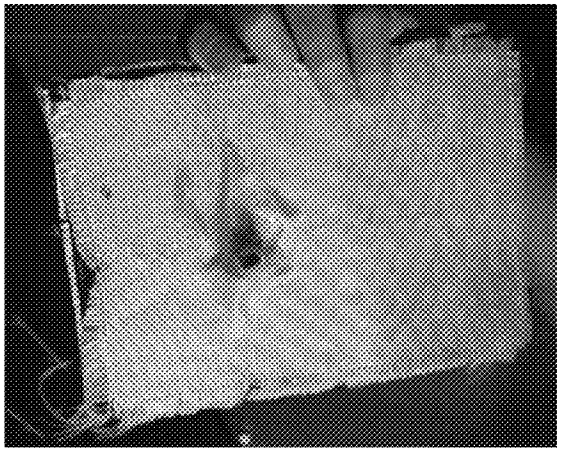

FIG. 17B shows the back surface of the 20 gauge steel panel of FIG. 17A. The back layer appears to show a can-opening effect on the metal plate, and the bullet penetrating through every layer, with windowing of the fabric.

Figure 18A:
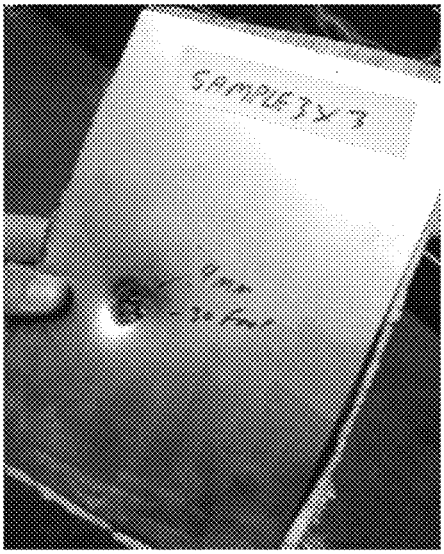
FIGS. 18A and 18B show a 20 gauge steel panel with three layers of butyl and Kevlar® 29 Denier 1500 shot with 9 mm projectiles.

FIG. 18A shows the front surface of a test panel, a 6 inch×9 inch 20 gauge steel panel, with its back covered with three (3) layers of butyl and three (3) layers of Kevlar® 29 Denier 1500. The panel was shot from 30 feet with 9 mm projectile(s) into the front surface.

Figure 18B:
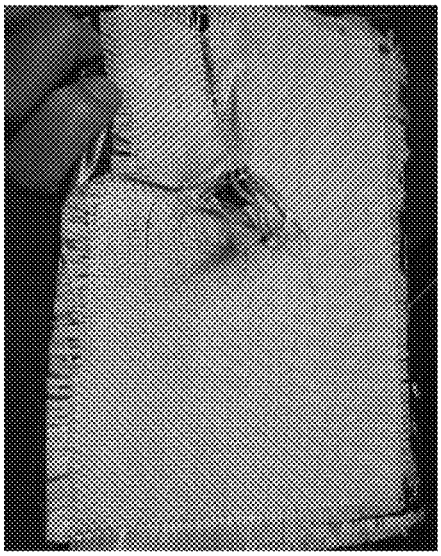

FIG. 18B shows the back surface of the 20 gauge steel panel of FIG. 18A. The back layer appears to show a can-opening effect on the metal plate, and the bullet penetrating through every layer, with windowing of the fabric.

Figure 19A:
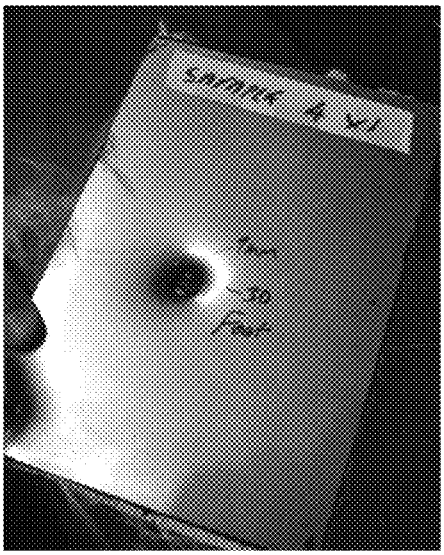
FIGS. 19A and 19B show a 20 gauge steel panel with one layer of butyl and Kevlar® 29 Denier 3000 shot with 9 mm projectiles.

FIG. 19A shows the front surface of a test panel, a 6 inch×9 inch 20 gauge steel panel, with its back covered with one (1) layer of butyl and one (1) layer of Kevlar® 29 Denier 3000. This fabric adhered to the butyl layer very well. The panel was shot from 30 feet with 9 mm projectile(s) into front surface.

Figure 19B:
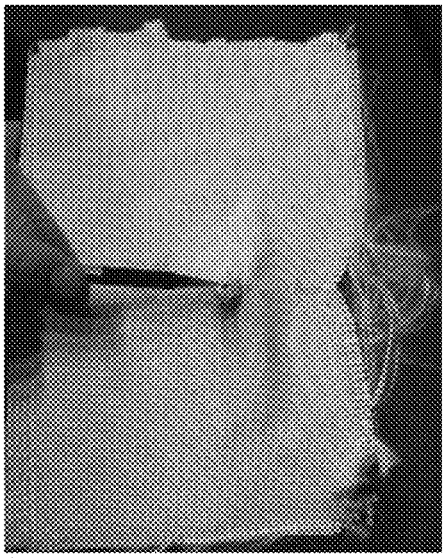

FIG. 19B shows the back surface of the 20 gauge steel panel of FIG. 19A. The back layer appears to show a can-opening effect on the metal plate, and the bullet penetrating through every layer, with windowing of the fabric, and bubbling of the adhesive (butyl).

Figure 20A:
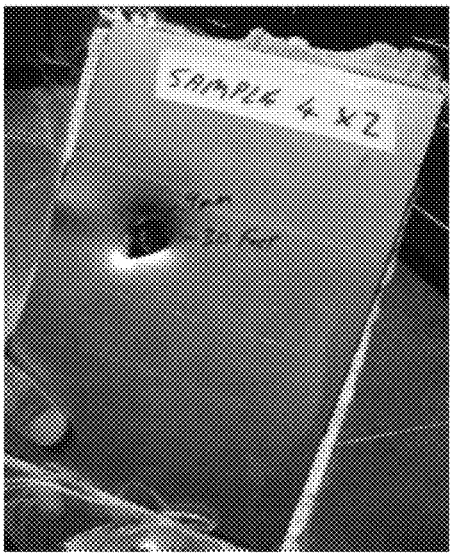
FIGS. 20A and 20B show a 20 gauge steel panel with two layers of butyl and Kevlar® 29 Denier 3000 shot with 9 mm projectiles.

FIG. 20A shows the front surface of a test panel, a 6 inch×9 inch 20 gauge steel panel, with its back covered with two (2) layers of butyl and two (2) layers of Kevlar® 29 Denier 3000. The panel was shot from 30 feet with 9 mm projectile(s) into the front surface.

Figure 20B:
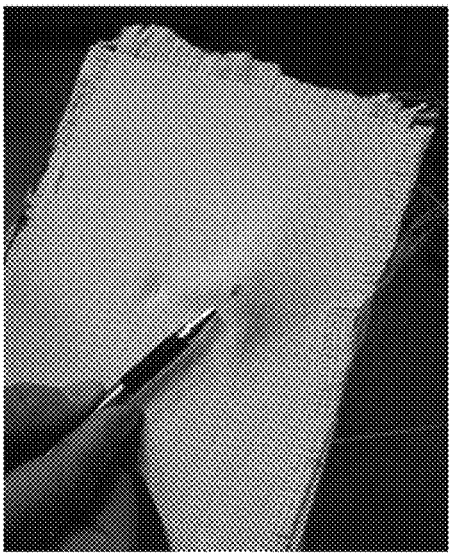

FIG. 20B shows the back surface of the 20 gauge steel panel of FIG. 20A. The back layer appears to show a can-opening effect on the metal plate, but the bullet failed to penetrate any of the layers, with some small mushrooming-type separation between the fabric and the butyl. The result was deemed a complete success.

Figure 21A:
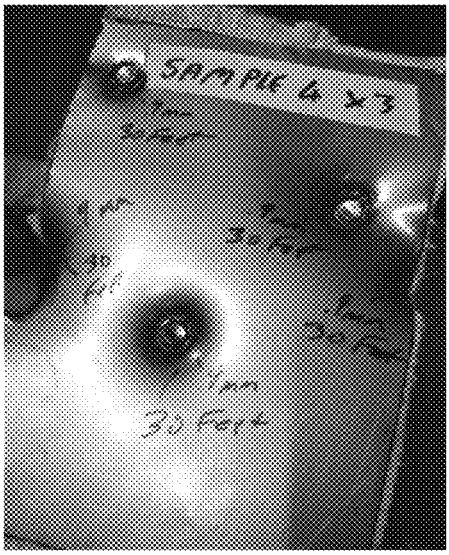
FIGS. 21A and 21B show a 20 gauge steel panel with three layers of butyl and Kevlar® 29 Denier 3000 shot with 9 mm projectiles.

FIG. 21A shows the front surface of a test panel, a 6 inch×9 inch 20 gauge steel panel, with its back covered with three (3) layers of butyl and three (3) layers of Kevlar® 29 Denier 3000. The panel was shot from 30 feet with 9 mm projectile(s) into the front surface.

Figure 21B:
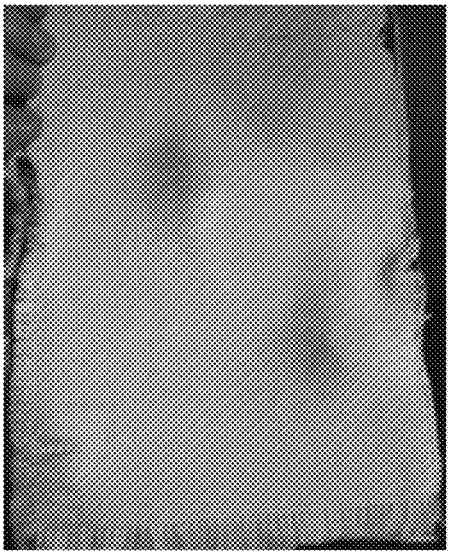

FIG. 21B shows the back surface of the 20 gauge steel panel of FIG. 21A. The back layer does not show a can-opening effect on the metal plate. The bullet hit in one place, made a hairline crack to start can opening, but did not penetrate. There was no mushrooming-type effect on the fabric of the butyl. The result was a complete success.

Figure 22A:
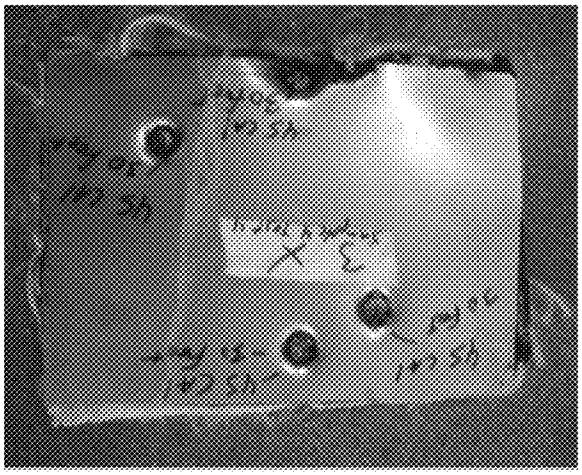
FIGS. 22A and 22B show a 20 gauge steel panel with three layers of butyl and Kevlar® 29 Denier 3000 shot with 45 caliper projectiles.

FIG. 22A shows the front surface of a test panel, a 6 inch×9 inch 20 gauge steel panel, with its back covered with three (3) layers of butyl and three (3) layers of Kevlar® 29 Denier 3000. The panel was shot from 30 feet with 45 caliper projectile(s) into the front surface.

Figure 22B:
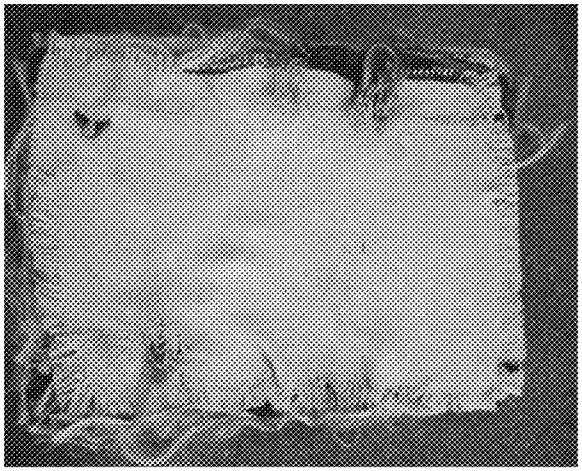

FIG. 22B shows the back surface of the 20 gauge steel panel of FIG. 22A. The bullets penetrated all layers. There was windowing of the fabric.

Figure 23A:
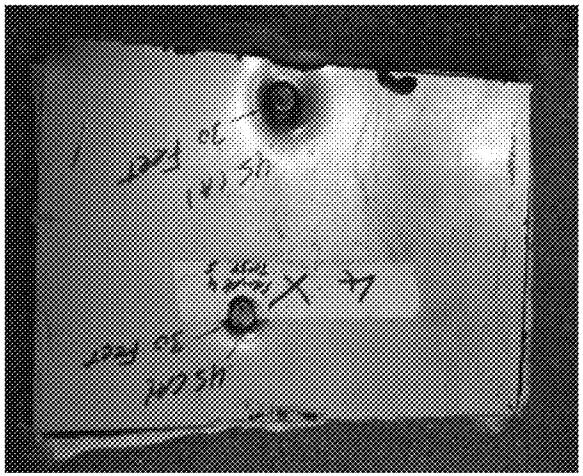
FIGS. 23A and 23B show a 20 gauge steel panel with four layers of butyl and Kevlar® 29 Denier 3000 shot with 45 caliper projectiles.

FIG. 23A shows the front surface of a test panel, a 6 inch×9 inch 20 gauge steel panel, with its back covered with four (4) layers of butyl and four (4) layers of Kevlar® 29 Denier 3000. The panel was shot from 30 feet with 45 caliper projectile(s) into the front surface.

Figure 23B:
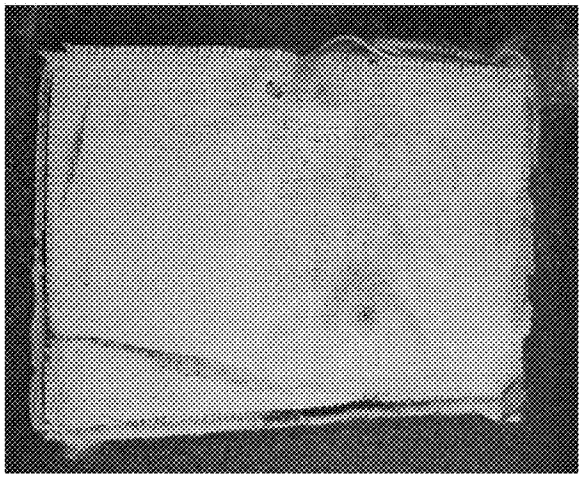

FIG. 23B shows the back surface of the 20 gauge steel panel of FIG. 23A. The bullets were completely stopped. There was mushrooming-type effect on the back, with separation of the layers material due to oils on the metal panel.

Figure 24A:
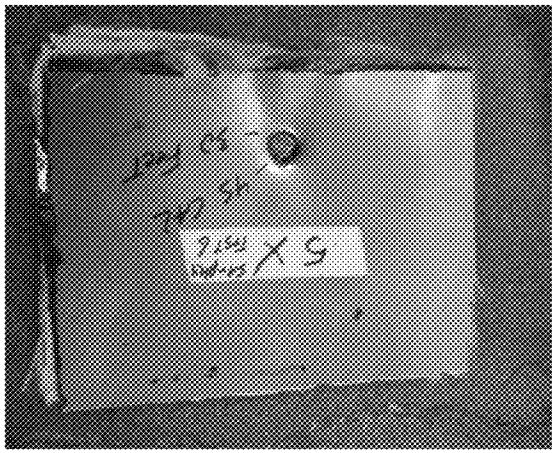
FIGS. 24A and 24B show a 20 gauge steel panel with five layers of butyl and Kevlar® 29 Denier 3000 shot with 45 caliper projectiles.

FIG. 24A shows the front surface of a test panel, a 6 inch×9 inch 20 gauge steel panel, with its back covered with five (5) layers of butyl and five (5) layers of Kevlar® 29 Denier 3000. The panel was shot from 30 feet with 45 caliper projectile(s) into the front surface.

Figure 24B:
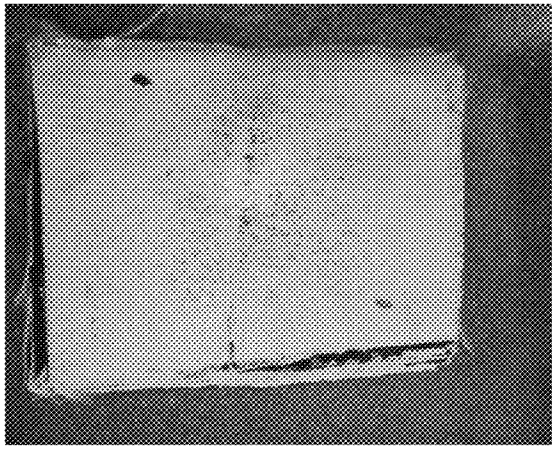

FIG. 24B shows the back surface of the 20 gauge steel panel of FIG. 24A. The bullets were completely stopped.

Figure 25A:
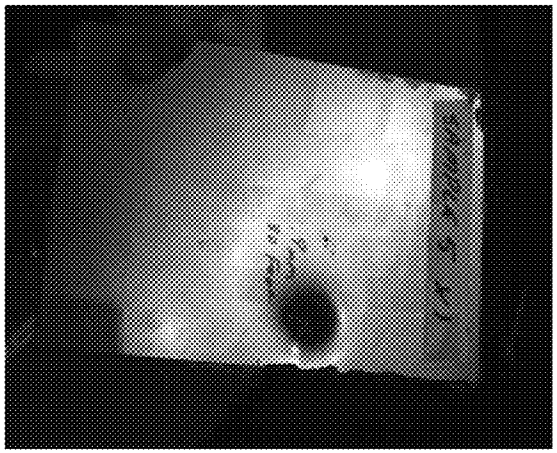
FIGS. 25A and 25B show a 20 gauge steel panel with one layer of butyl and Dyneema® shot with 9 mm projectiles.

FIG. 25A shows the front surface of a test panel, a 6 inch×9 inch 20 gauge steel panel, with its back covered with one (1) layer of butyl and one (1) layer of Dyneema® having a density of 290 gm/m$^2$. This fabric adhered to the butyl layer very well. The panel was shot from 30 feet with 9 mm projectile(s) into front surface.

Figure 25B:
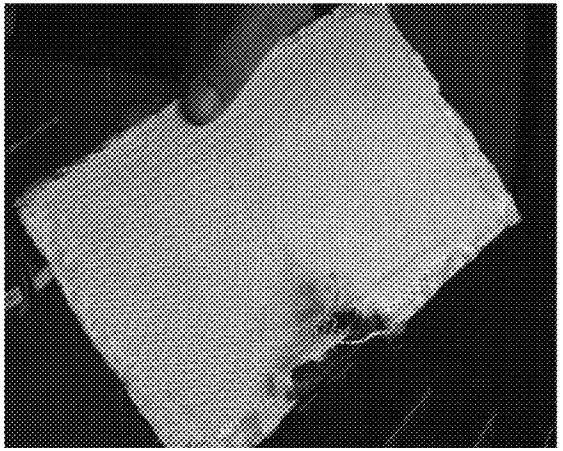

FIG. 25B shows the back surface of the 20 gauge steel panel of FIG. 25A. The back layer appears to show a can-opening effect on the metal plate, and the bullet penetrating through every layer, with delamination of the fabric, and windowing.

Figure 26A:
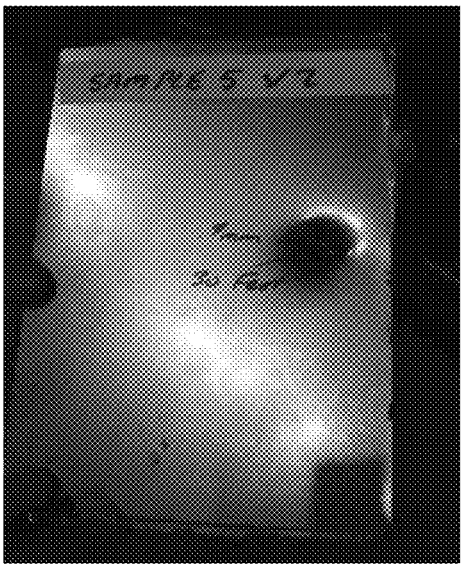
FIGS. 26A and 26B show a 20 gauge steel panel with two layers of butyl and Dyneema® shot with 9 mm projectiles.

FIG. 26A shows the front surface of a test panel, a 6 inch×9 inch 20 gauge steel panel, with its back covered with two (2) layers of butyl and two (2) layers of Dyneema® having a density of 290 gm/m$^2$. The panel was shot from 30 feet with 9 mm projectile(s) into front surface.

Figure 26B:
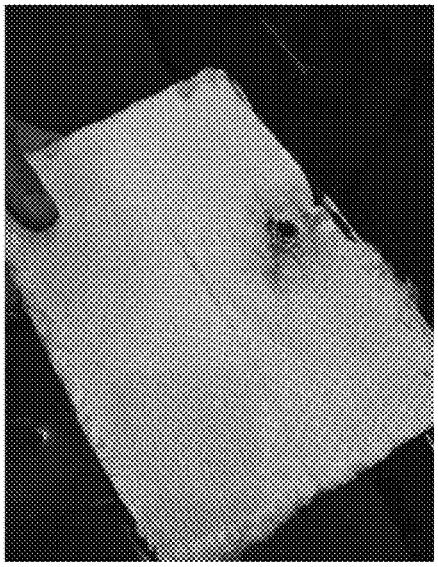

FIG. 26B shows the back surface of the 20 gauge steel panel of FIG. 26A. The back layer appears to show a can-opening effect on the metal plate, and the bullet penetrating through every layer, with hardly any delamination of the fabric, and windowing of the fabric with some broken threads in the weave.

Figure 27A:
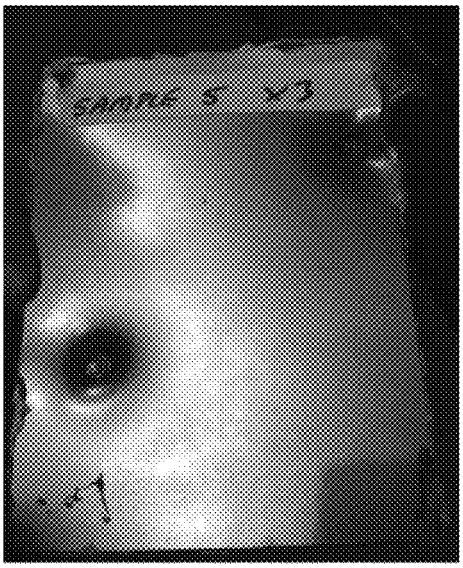
FIGS. 27A through 27C show a 20 gauge steel panel with three layers of butyl and Dyneema® shot with 9 mm projectiles.

FIG. 27A shows the front surface of a test panel, a 6 inch×9 inch 20 gauge steel panel, with its back covered with three (3) layers of butyl and three (3) layers of Dyneema® having a density of 290 gm/m$^2$. The panel was shot from 30 feet with 9 mm projectile(s) into front surface.

Figure 27B:
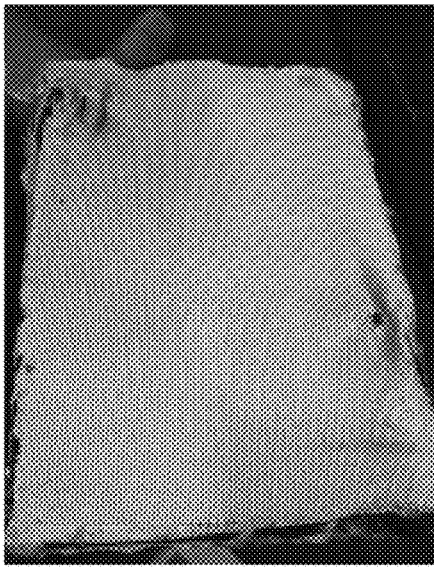
Figure 27C:
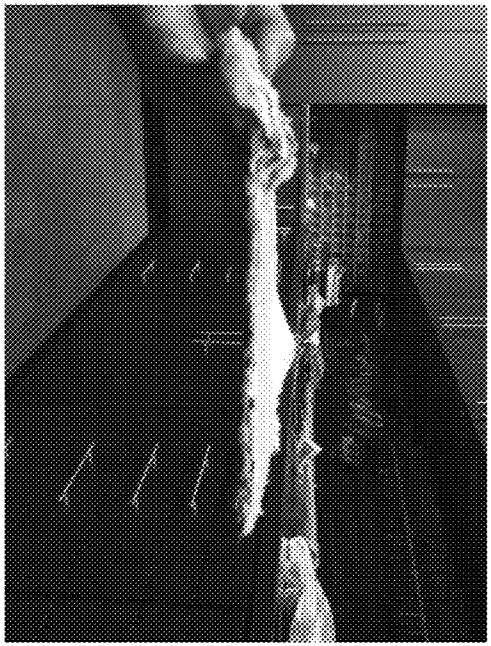

FIGS. 27B and 27C show the back surface of the 20 gauge steel panel of FIG. 27A. The back layer appears to show a can-opening effect on the metal plate, though the bullet did not penetrate through any layer of the fabric. There was no delamination, though there was a mushrooming effect where the bullet stopped.

Figure 28A:
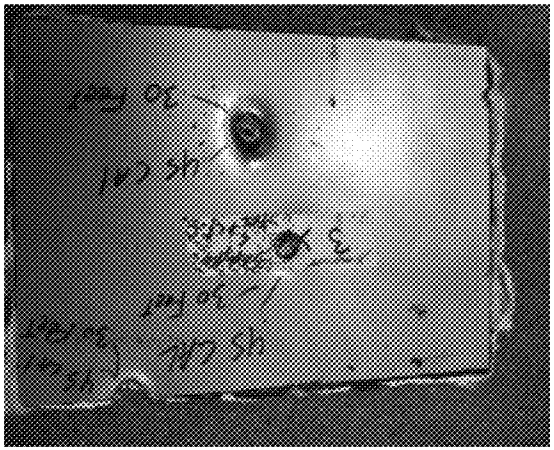
FIGS. 28A and 28B show a 20 gauge steel panel with three layers of butyl and Dyneema® shot with 45 caliper projectiles.

FIG. 28A shows the front surface of a test panel, a 6 inch×9 inch 20 gauge steel panel, with its back covered with three (3) layers of butyl and three (3) layers of Dyneema® having a density of 290 gm/m$^2$. The panel was shot from 30 feet with 45 caliper projectile(s) into front surface.

Figure 28B:
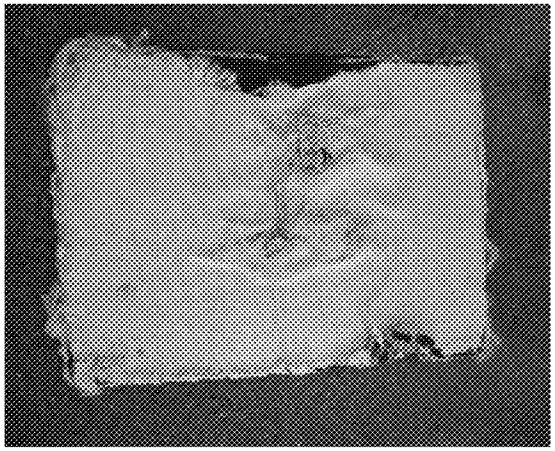

FIG. 28B shows the back surface of the 20 gauge steel panel of FIG. 28A. The back layer appears to show a can-opening effect on the metal plate, with the bullets penetrating through all layers of the fabric. There were broken fibers.

Figure 29A:
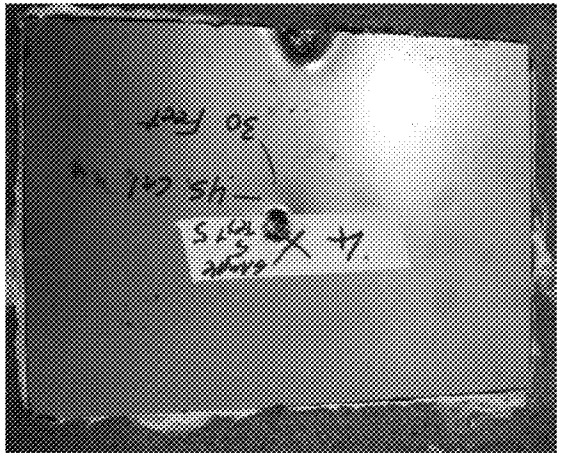
FIGS. 29A and 29B show a 20 gauge steel panel with four layers of butyl and Dyneema® shot with 45 caliper projectiles.

FIG. 29A shows the front surface of a test panel, a 6 inch×9 inch 20 gauge steel panel, with its back covered with four (4) layers of butyl and four (4) layers of Dyneema® having a density of 290 gm/m$^2$. The panel was shot from 30 feet with 45 caliper projectile(s) into front surface.

Figure 29B:
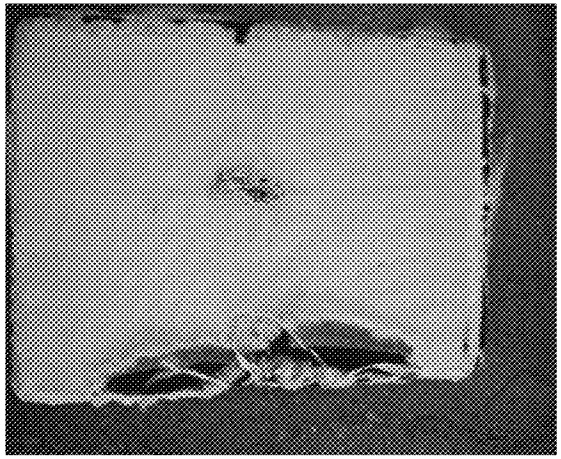

FIG. 29B shows the back surface of the 20 gauge steel panel of FIG. 29A. The bullets penetrated through all layers of the fabric. There were no broken fibers, though a windowing effect.

Figure 30A:
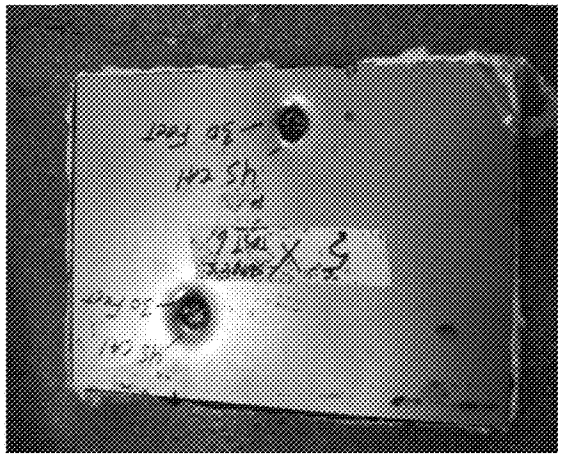
FIGS. 30A and 30B show a 20 gauge steel panel with five layers of butyl and Dyneema® shot with 45 caliper projectiles.

FIG. 30A shows the front surface of a test panel, a 6 inch×9 inch 20 gauge steel panel, with its back covered with five (5) layers of butyl and five (5) layers of Dyneema® having a density of 290 gm/m$^2$. The panel was shot from 30 feet with 45 caliper projectile(s) into front surface.

Figure 30B:
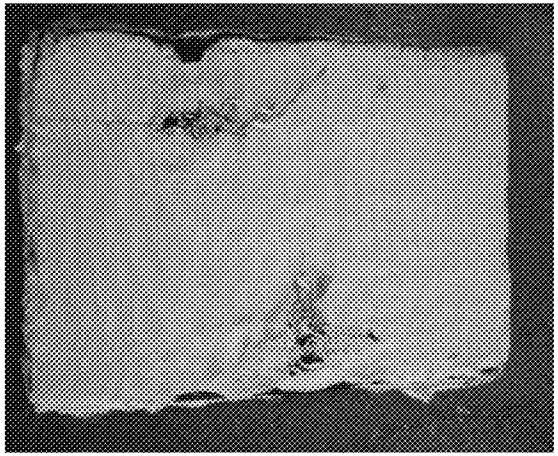

FIG. 30B shows the back surface of the 20 gauge steel panel of FIG. 30A. The bullets penetrated through all layers of the fabric. There was a windowing effect.

Figure 31A:
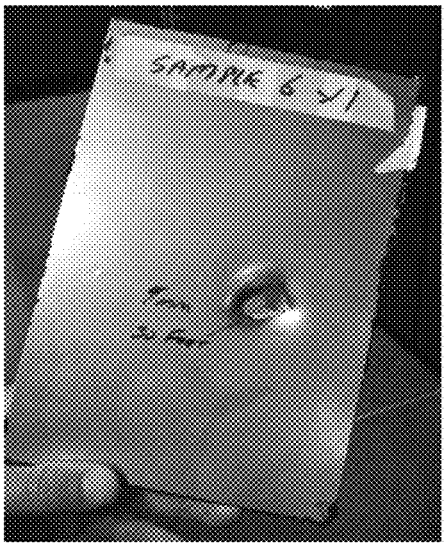
FIGS. 31A and 31B show a 20 gauge steel panel with one layer of butyl and PE UD 35 fabric shot with 9 mm projectiles.

FIG. 31A shows the front surface of a test panel, a 6 inch×9 inch 20 gauge steel panel, with its back covered with one (1) layer of butyl and one (1) layer of PE UD 135 fabric under the brand "H+T", with a density of 135 gm/m$^2$. The panel was shot from 30 feet with 9 mm projectile(s) into front surface.

Figure 31B:
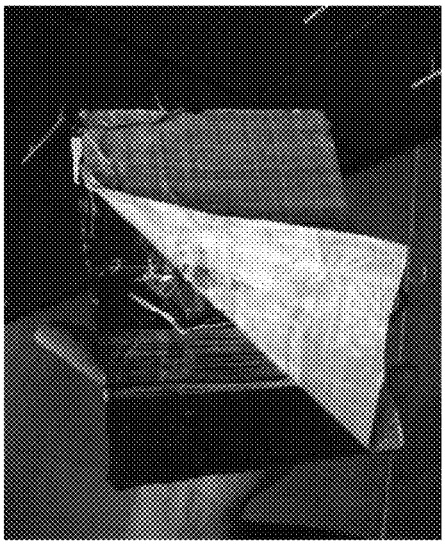

FIG. 31B shows the back surface of the 20 gauge steel panel of FIG. 31A. The back layer appears to show a can-opening effect on the metal plate, and the bullet penetrating through every layer, with separation of the fabric layers, with strands still attached to the butyl layer.

Figure 32A:
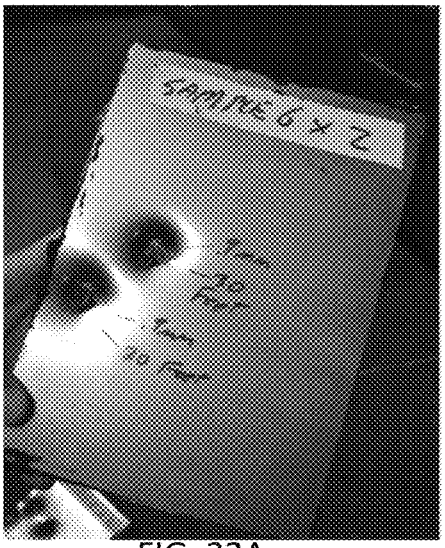
FIGS. 32A and 32B show a 20 gauge steel panel with two layers of butyl and PE UD 35 shot with 9 mm projectiles.

FIG. 32A shows the front surface of a test panel, a 6 inch×9 inch 20 gauge steel panel, with its back covered with two (2) layers of butyl and two (2) layers of PE UD 135. The panel was shot from 30 feet with 9 mm projectile(s) into front surface.

Figure 32B:
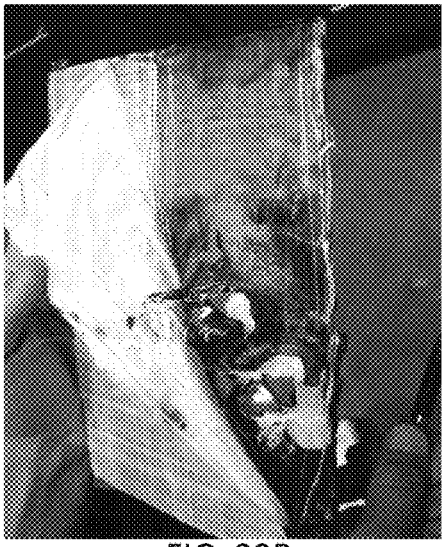

FIG. 32B shows the back surface of the 20 gauge steel panel of FIG. 32A. The back layer appears to show a can-opening effect on the metal plate, and the bullet penetrating through every layer, with delamination.

Figure 33A:
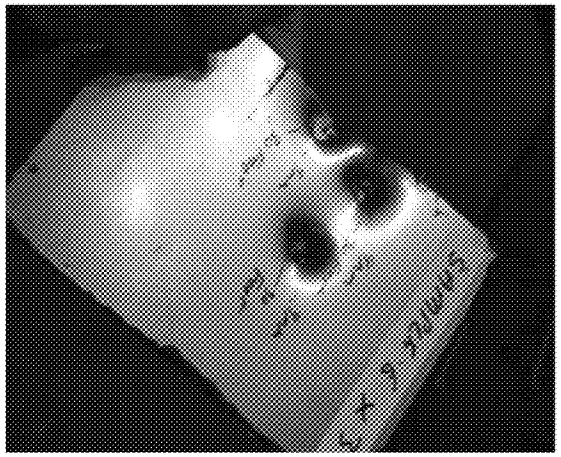

FIG. 33A shows the front surface of a test panel, a 6 inch×9 inch 20 gauge steel panel, with its back covered with three (3) layers of butyl and three (3) layers of PE UD 135. The panel was shot from 30 feet with 9 mm projectile(s) into front surface.

Figure 33B:
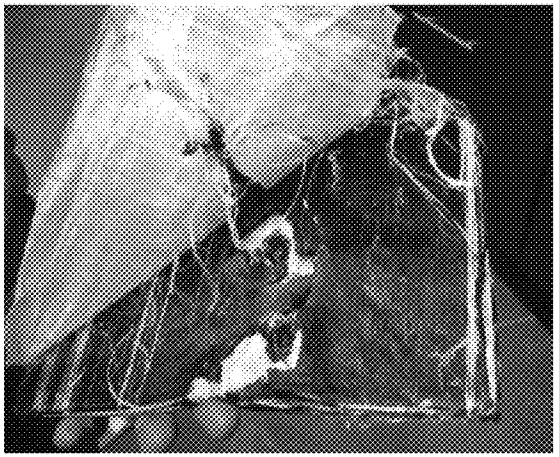

FIG. 33B shows the back surface of the 20 gauge steel panel of FIG. 33A. The back layer showed delamination and poor adhesion with this sample, with the bullets penetrating through every layer. The fabric separated from the butyl.

I claim:

1. A flexible ballistic shield having an adhesive surface for bonding the ballistic shield to a substrate, the ballistic shield comprising at least a base layer of a bonding butyl rubber material and at least a first layer of a ballistic fabric material disposed on an outer-facing surface of the base layer of bonding butyl rubber material, the inner-facing surface of the base layer providing the adhesive surface of the ballistic shield, the bonding butyl rubber material comprising: a butyl rubber selected from the group consisting of polyisobutene, a copolymer of isobutylene and isoprene, and a combination thereof, for attaching the ballistic shield to a substrate of a vehicle or structure, wherein the adhesive, cohesive and elastic qualities of the butyl rubber material penetrate into the threads of the ballistic fabric, and adhere the base surface of the ballistic shield tenaciously to a surface of a substrate.

2. The ballistic shield according to claim 1, the bonding butyl rubber material further comprising a plasticizer or a tackifying agent.

3. The ballistic shield according to claim 2 wherein the bonding butyl rubber material further comprises carbon black and a filler material.

4. The ballistic shield according to claim 3, further including a handling fabric layer disposed on an outer surface of an outermost layer of butyl rubber.

5. The ballistic shield according to claim 3, further including a releasable protective layer on the inner-facing surface of the base layer of bonding butyl rubber material, to protect the inner-facing surface of the base layer from particulate contamination prior to use of the flexible ballistic shield.

6. The ballistic shield according to claim 3 wherein the ballistic fabric is made from ballistic fibers selected from the group consisting of aramid fibers and ultra-high-molecular-weight polyethylene (UHMWPE) fibers.

7. The ballistic shield according to claim 1 including at least two layers of the bonding butyl rubber material, including the base layer and a second layer, with the first layer of ballistic fabric material disposed between the at least two layers of the bonding butyl rubber material, and including a second layer of ballistic fabric material disposed on an outer surface of the second layer of bonding butyl rubber material.

8. The ballistic shield according to claim 7 further including one or more additional layers of bonding butyl rubber material, and one or more additional layers of ballistic fabric material, disposed between successive layers of the bonding butyl rubber material.

9. A method of applying a flexible ballistic shield to the inside surface if a resilient wall or structure, comprising the steps of:

(i) providing a flexible ballistic shield according to claim 1;

(ii) attaching the inner-facing adhesive surface of the base layer of bonding butyl rubber material of the ballistic shield to an inside surface of a wall or structure; and (iii) applying pressure to the outer surface of the flexible ballistic shield sufficient to adhere the ballistic shield to the inside surface of the wall or structure.

10. The method according to claim 9 wherein prior to the steps (ii) of attaching, the inside surface of the wall or structure is cleaned of dirt, dust, or other foreign particulate matter including oily material.

11. The method according to claim 9 wherein heat is applied to the applied flexible ballistic shield or to the inside surface of the wall or structure, prior to the step (iii) of applying pressure, to improve adhesion of the base layer of bonding butyl rubber material to the wall, and the further penetration of bonding butyl rubber material into the layers of the ballistic fabric.

12. A method of making a flexible ballistic shield according to claim 1, comprising the steps of:

a. providing a plurality of ballistic-resistant layers comprising ballistic fabric material, b. providing a plurality of bonding rubber material layers comprising a bonding butyl rubber material comprising: a butyl rubber selected from the group consisting of polyisobutene, a copolymer of isobutylene and isoprene, and a combination thereof; a plasticizer or a tackifying agent; carbon black; and a filler material, c. forming a stack comprising alternating layers of the ballistic-resistant layers and the bonding rubber material layers, and d. applying pressure to the stack to adhere the plurality of bonding rubber material layers to the plurality of ballistic-resistant layers.

13. The method according to claim 12 wherein an innermost layer of the stack of the ballistic-resistant layers and the bonding rubber material layers is one of the bonding rubber material layers, and a release layer material is disposed on an inner-facing surface of the innermost bonding rubber material layer.

14. The method according to claim 12 wherein at least 1 psi pressure is applied to the stack, and further including applying heat to the stack before or while applying pressure.

15. The ballistic shield according to claim 1, wherein the ballistic shield has flexibility sufficient to form to a shape of the substrate.

16. The ballistic shield according to claim 15, wherein the adhesion, cohesion and elasticity of the butyl rubber attaching adhesively to the ballistic fabric contribute to stopping of a projectile.

17. The ballistic shield according to claim 1, wherein the layer of the butyl rubber has a thickness of at least 0.5 mm.

18. The ballistic shield according to claim 17, wherein the layer of the butyl rubber has a thickness of at least 1 mm.

19. The ballistic shield according to claim 18, further including one or more additional layers of bonding butyl rubber material, and one or more additional layers of ballistic fabric material, disposed between successive layers of the bonding butyl rubber material.

20. The ballistic shield according to claim 19, wherein the adhesion, cohesion and elasticity of the butyl rubber attaching adhesively to the ballistic fabric contribute to stopping of a projectile.

* * * * *